US006630770B1

(12) United States Patent
Okubo

(10) Patent No.: US 6,630,770 B1
(45) Date of Patent: Oct. 7, 2003

(54) AUTOMOTIVE HEADLAMP WITH SUPPORT WIRE POSITIONING

(75) Inventor: Yasuhiro Okubo, Isehara (JP)

(73) Assignee: Ichikoh Industries, Ltd., Tokyo (JP)

( * ) Notice: Subject to any disclaimer, the term of this patent is extended or adjusted under 35 U.S.C. 154(b) by 0 days.

(21) Appl. No.: 09/442,770

(22) Filed: Nov. 18, 1999

(30) Foreign Application Priority Data

Nov. 20, 1998 (JP) ..... 10-331351
Nov. 20, 1998 (JP) ..... 10-331352

(51) Int. Cl.[7] ..... H01J 5/16

(52) U.S. Cl. ..... 313/115; 313/579; 313/113; 313/316

(58) Field of Search ..... 313/316, 315, 313/113, 115, 578, 579

(56) References Cited

U.S. PATENT DOCUMENTS 3,646,385 A * 2/1972 Wichert ..... 313/114
4,580,199 A * 4/1986 Wurster et al. ..... 313/115
5,857,764 A * 1/1999 Tabata et al. ..... 313/112
6,271,622 B1 * 8/2001 Coushaine et al. ..... 313/112
6,281,630 B1 * 8/2001 English et al. ..... 313/635

FOREIGN PATENT DOCUMENTS

| | | |
|---|---|---|
| EP | 0 817 243 | 7/1998 |
| JP | 8329703 | 12/1996 |
| JP | 8-329703 | 12/1996 |
| JP | 9-306220 | 11/1997 |
| WO | WO 98/49716 | 11/1998 |

* cited by examiner

*Primary Examiner*—Ashok Patel
*Assistant Examiner*—Glenn Zimmerman
(74) *Attorney, Agent, or Firm*—Foley & Lardner

(57) ABSTRACT

A light source bulb in an automotive headlamp having a lamp chamber defined by a lamp housing and a lens, where the lamp chamber includes a reflector and the light source bulb arranged therein. The reflector includes a reflecting surface constituted by a complex reflecting surface. The light source bulb includes a high-beam filament arranged obliquely below and behind with respect to a low-beam filament. When lit, high and low beam distribution patterns are formed by entire-surface reflection light distribution control of the reflecting surface. The light source bulb is used for right traffic and for left traffic. A second support wire is, in a side view of said light source bulb, bent to rearward of the rear end of said high-beam filament and positioned above the lower end of said low-beam filament.

13 Claims, 25 Drawing Sheets

AUTOMOTIVE HEADLAMP WITH SUPPORT WIRE POSITIONING

BACKGROUND OF THE INVENTION a) Field of the Invention

The present invention relates to a light source bulb in automotive headlamps, such as two-lamp type halogen headlamps, in which a prescribed low beam distribution pattern and high beam distribution pattern each can be obtained by entire-surface reflection light distribution control of the reflecting surface of a reflector, the light source bulb being capable of use both as a light source bulb in an automotive headlamp for right traffic and a light source bulb in an automotive headlamp for left traffic in one, without causing a problem of virtual image glare.

Incidentally, as employed in the present specification document and the accompanying drawings, the symbol "A" represents the front as seen from the driver-side along the traveling direction of an automobile. As seen in the same manner, the symbol "B" represents the back, the symbol "L" the left, the symbol "R" the right, the symbol "U" the upper, and the symbol "D" the lower. In addition, the symbols "HL-HR" represent a horizontal line seen in front from the driver-side (i.e., driver's view), and the symbols "HR-HL" represent a horizontal line seen as the automobile- or the headlamp-side is viewed from the front (so-called front view or plane view). The symbols "VU-VD" represent a vertical line. Further, as employed both in the appended claims and in the present specification document, the terms "front," "back," "left," "right," "upper," and "lower" each has the same meaning.

b) Description of the Prior Art

Automotive headlamps in which a prescribed low beam distribution pattern and high beam distribution pattern each can be obtained by entire-surface reflection light distribution control of the reflecting surface of its reflector include, for example, those described in Japanese Patent Laid-Open Publication No. Hei 8-329703.

Hereinafter, the outline of such an automotive headlamp will be described with reference to FIGS. 1 through 3. Note that the automotive headlamp illustrated is to be mounted on the left side of an automobile for right traffic. An automotive headlamp to be mounted on an automobile for left traffic is the reverse of this illustrated automotive headlamp in the horizontal arrangement of a reflecting surface 40, a high-beam filament 52, and the like. Moreover, an automotive headlamp to be mounted on the right side of an automobile, while identical to this illustrated automotive headlamp in the arrangement of the reflecting surface 40, the high-beam filament 52, and the like, replaces its lamp housing 1, lens 2, and reflector 4 with those generally symmetrical in shape.

This automotive headlamp has a lamp chamber 3 defined by the lamp housing 1 and the lens (outer lens) 2. In this lamp chamber 3, the reflector 4 separately formed from the lamp housing 1 is arranged to be rotatable in vertical and horizontal directions, by a pivot mechanism (not shown), an optical axis adjustment mechanism (not shown), and the like. This reflector 4 has a reflecting surface 40 constituted by a complex reflecting surface. This reflecting surface 40, i.e. the complex reflecting surface, comprises reflecting surface segments (not shown) sectioned in a plurality of pieces all around, and is referred to as so-called free-form curved surface. This complex reflecting surface, as described in Japanese Patent Laid-Open Publication No. Hei 9-306220. for example, includes that divided into a large number of blocks, that divided into a small number of blocks, and that having a plurality of blocks continuously connected with one another (the connecting lines therebetween not being visible).

In the strict sense, this complex reflecting surface has more than one single focus. The plurality of paraboloids of revolution constituting the complex reflecting surface, however, differ in focal length from each other but merely slightly, and practically share the same focus. Thus, the focus will be referred to as focus F in the present specification document, while the focus F shown in the drawings is a pseudo focus in the strict sense. Similarly, while the optical axis Z-Z (also referred to as reference axis Z-Z) shown in the drawings is a pseudo optical axis in the strict sense, it will be referred to as optical axis in the present specification document.

To the above-described reflector 4 is detachably attached a light source bulb 5. This light source bulb 5 is a light source bulb with no shading hood, in which a low-beam (dipped-beam) filament 51 and a high-beam (main-beam) filament 52 are arranged in a glass envelope 50, and this glass envelope is provided with, e.g., coating 54 of black paint (for intercepting direct lights from the low-beam filament 51 and high-beam filament 52 to the lens 2) at an extremity thereof.

The low-beam filament 51 mentioned above forms a generally cylindrical shape of coil structure, and is generally parallel to the optical axis Z-Z. This filament 51 is positioned forward of the focus F. The high-beam filament 52 also forms a generally cylindrical shape of coil structure, and is generally parallel to the optical axis Z-Z. This filament 52 is positioned in the vicinity of the focus F and obliquely below the low-beam filament 51 (at the lower rightward as shown in FIG. 11A, for the right-traffic; at the lower leftward as shown in FIG. 6C, for the left-traffic). The central axis of the low-beam filament 51 described above generally coincides with the aforementioned optical axis Z-Z (reference axis Z-Z), and lies below the central axis of the aforementioned glass envelope 50, i.e., below the envelope axis Z'-Z'. The reason why the central axis Z-Z of this low-beam filament 51 is positioned below the envelope axis Z'-Z' is to obtain a stable light-shade boundary line 71 (so-called cut line) in the low-beam distribution pattern shown in FIG. 4 to be described later. That is, as previously known, the central axis Z-Z of the low-beam filament 51 is shifted to downward of the envelope axis Z'-Z' to prevent the converged image (virtual image) of the reflected light in the inner peripheral portion of the glass envelope 50 from appearing above the light-shade boundary line 71 of the low beam distribution pattern LP.

In the drawings, reference numeral 6 designates a shade. This shade 6 is fixed to the aforesaid reflectors 4 and covers the front of the aforesaid light source bulb 5, so as to intercept the direct lights from the low-beam filament 51 and the high-beam filament 52 to the invalid portions 42 (portions with no direct involvement to the light distribution of the headlamp) of the reflector 4 and to the lens 2. In addition, reference numeral 60 designates a rubber cap. This rubber cap 60 is watertightly and detachably attached to between the base of the light source bulb 5 and the rear opening portion of the lamp housing 1 via an attaching cap 61, thereby maintaining the interior of the lamp chamber 3 watertight.

Now, when in the automotive headlamp described above the low-beam filament 51 is lit, lights from this low-beam filament 51 are reflected over the entire surface of the reflecting surface 40 of the reflector 4, and the reflected lights are irradiated out through the lens 2 with the prescribed low beam distribution pattern LP shown in FIG. 4. When in contrast the high-beam filament 52 is lit, lights from this high-beam filament 52 are reflected over the entire surface of the reflecting surface 40, and the reflected lights are irradiated out through the lens 2 with a prescribed high beam distribution pattern HP shown in FIG. 5.

In this way, the prescribed low beam distribution pattern LP and the prescribed high beam distribution pattern HP each is formed by the entire-surface reflection light distribution control of the reflecting surface 40 of the reflector 4.

The prescribed low beam distribution pattern LP and prescribed high beam distribution pattern HP mentioned above designate those light distribution patterns conformable to light distribution standards such as ECE Reg. the European light distribution standards, the ones based on the same (e.g., Japanese type approval standard and the like), and FMVSS the North America light distribution standards.

The low beam distribution pattern LP described above is standardized in light distribution so as to limit the occurrence of glare. This results in the aforementioned low beam distribution pattern LP with the light-shade boundary line 71, as shown in FIG. 4, taking account of a car 7 on the opposite lane and a pedestrian 70 on the right shoulder of the road. More specifically, this light-shade boundary line 71 comprises a horizontal line portion 72, a gentle tilt line portion 73, and a tilt line portion 74. The horizontal line portion 72 extends from the left end to the approximate center, lying somewhat below the horizontal line HL-HR so as not to cause glare to the car 7 on the opposite lane. The gentle tilt line portion 73 tilts up rightward from the horizontal line portion 72 at the approximate center with a gentle angle, e.g. an angle of 15°, so as to observe the pedestrian 70 on the right shoulder without causing glare to the pedestrian 70. The tilt line portion 74 tilts down rightward from the gentle tile line portion 73 to return to the horizontal line portion 72 again. This low beam distribution pattern LP has no standard on the maximum value of light intensity. In contrast, the high beam distribution pattern HP mentioned above is standardized in light distribution on the maximum value of light-intensity and the maximum light intensity zone. This results in the above-mentioned high beam distribution pattern HP having a hot zone HZ (the maximum light intensity zone including the maximum light intensity point) at the center, as shown in FIG. 5. Here, in the European light distribution standards ECE Reg., the maximum value of light intensity is 48–240 lx (1 1x=625 cd; measurement on a 25-m-away screen), and the value of light intensity at the intersection between the horizontal line HL-HR and the vertical line VU-VD is equal to or greater than 80% (certified) the maximum value of light intensity.

What is important in the automotive headlamp described above is that a favorable low beam distribution pattern LP can be obtained without causing the glare problem, as well as that a favorable high beam distribution pattern can be obtained.

Here, the light source bulb 5 described above is divided into a left-traffic light source bulb 5L for use in an automotive headlamp for left traffic or a right-traffic light source bulb 5R for use in an automotive headlamp for right traffic, both for dedicated use. More specifically, the left-traffic light source bulb 5L has a high-beam filament 52 positioned at the lower leftward of its low-beam filament 51, as shown in FIGS. 6C and 15A. Meanwhile, the right-traffic light source bulb 5R has a high-beam filament 52 positioned at the lower rightward of its low-beam filament 51, as shown in FIGS. 11A and 12A. Thus, the high-beam filaments 52 in the left-traffic light source bulb 5L and the right-traffic light source bulb 5R are arranged in symmetric positions to each other with respect to the central axis Z-Z of the low-beam filament 51.

On this account, the light source bulb 5 described above is rotated to the right or left about the central axis Z-Z of the low-beam filament 51 so that the light source bulb 5 can cope with both the left-traffic light source bulb 5L and the right-traffic light source bulb 5R in one.

However, depending on conditions in constituting the light source bulb 5, the above-described rotation can produce a change in light distribution which might be an obstacle to the function of the low-beam filament 51, i.e., a glare problem.

Hereinafter, the aforementioned glare problem will be described in conjunction with the case of resulting from lead wires and support wires of the light source bulb 5 and the case of resulting from the glass envelope of the light source bulb 5, with reference to FIGS. 6A–11C and FIGS. 12A–15D, respectively.

First, description will be given of the glare problem resulting from lead wires and support wires of the light source bulb 5.

In a left-traffic light source bulb 5L, lead wires LW1, LW2, LW3, and LW4, and support wires SW1, SW2, and SW3 are arranged as shown in the neutral state of FIGS. 6B, 7, and 8. More specifically, a first lead wire LW1 extended from the front end 51A (the corner between the front end 51A and upper end 51U) of the low-beam filament 51 is supported on the front end portion of a first support wire SW1. A second lead wire LW2 extended from the rear end 51B (the corner between the rear end 51B and upper end 51U) of the low-beam filament 51 is supported on the upper part of the vertical bent part of a second support wire SW2. A third lead wire LW3 extended from the rear end 52B (the corner between the rear end 52B and upper end 52U) of the high-beam filament 52 is supported on the lower part of the vertical bent part of the aforesaid second support wire SW2. A fourth lead wire LW4 extended from the front end 52A (the corner between the front end 52A and lower end 52D) of the high-beam filament 52 is supported on the front end portion of a third support wire SW3. Each of the aforesaid support wires SW1, SW2, and SW3 is supported on a bridge 57 made of glass. The aforesaid first lead wire LW1, second lead wire LW2, third lead wire LW3, first support wire SW1, and second support wire SW2 are positioned on the vertical line VU-VD connecting the low-beam filament 51 to the high-beam filament 52. The aforesaid fourth lead wire LW4 and third support wire SW3 lie at approximately the same level as that of the high-beam filament 52. This third support wire SW3 is extended from the bridge 57 to the front partway, where the wire is once bent leftward to avoid the high-beam filament 52 before it is bent again and extended to the front.

This left-traffic light source bulb 5L in its neutral state shown in FIGS. 6B, 7, and 8 is then rotated to the right or left about the central axis Z-Z of the low-beam filament 51, and built into an automotive headlamp for left traffic in the state shown in FIG. 6C for use. Lighting the low-beam filament 51 of this left-traffic light source bulb 5L offers a prescribed low beam distribution pattern (light distribution pattern horizontally inverted from the low beam distribution pattern LP shown in FIG. 4). Lighting the high-beam filament 52 offers a prescribed high beam distribution pattern (light distribution pattern horizontally inverted from the high beam distribution pattern HP shown in FIG. 5). When the low-beam filament 51 is lit as mentioned above, the radiation of the low-beam filament 51 illuminates each wire LW1, LW2, LW3, LW4, and each support wire SW1, SW2, SW3 to shine (the closer to the low-beam filament 51 and the larger the exposed area is, the higher the intensity is).

Here, in the cases where the left-traffic light source bulb 5L in its neutral state is rotated to the right or left about the central axis Z-Z of the low-beam filament 51 and built into a right-traffic automotive headlamp in the state shown in FIG. 6A for use, a glare problem arises as described below.

That is, when the left-traffic light source bulb 5L is incorporated with a right-traffic automotive headlamp for use, the fourth lead wire LW4 and the third support wire SW3 are positioned below the lower end 51D of the lower-beam filament 51, as shown in FIG. 6A. On this account, as shown in FIG. 9, the lower end 51D of the low-beam filament 51 appears above the light-shade boundary line 71 (the horizontal line portion 72, the gentle tilt line portion 73), and the low-beam filament 51, the first lead wire LW1, second lead wire LW2, and first support wire SW1 (also including the high-beam filament 52, third lead wire LW3, and second support wire SW2, even though omitted of illustration in FIG. 9) appear below the light-shade boundary line 71. Meanwhile, the aforesaid fourth lead wire LW4 and third support wire SW3 positioned below the lower end 51D of the low-beam filament 51 appear above the light-shade boundary line 71 (the horizontal line portion 72, the gentle tilt line portion 73). Incidentally, in FIG. 9, the images of the low-beam filament 51, the high-beam filament 52, each lead wire LW1, LW2, LW3, LW4, and each support wire SW1, SW2, SW3 are diffused to the right and left, or to the upper right and lower left, as shown by the arrows.

As a result, the fourth lead wire LW4 and third support wire SW3 described above make virtual image glare. This causes, as shown in FIG. 10, the virtual image glare VIG to appear on the point P (B50L; a point shown by the double circle in FIG. 10) and zone Z (zone III; a part shown by the oblique lines in FIG. 10, exceeding the limit) where glare is severely restricted by the European light distribution standards ECE Reg.

The foregoing constitutes the description on the production of the glare problem in the case where a left-traffic light source bulb 5L is built into a right-traffic automotive headlamp for use. Hereinafter, referring to FIG. 11, description will be made on the glare problem in the case where a right-traffic light source bulb 5R is incorporated with a left-traffic automotive headlamp for use.

As shown in its neutral state of FIG. 11B, this right-traffic light source bulb 5R has a fourth lead wire LW4 and a third support wire SW3 positioned on the right of its high-beam filament 52, at approximately the same level as that of the high-beam filament 52. On this account, no glare problem arises when the bulb in its neutral state shown in FIG. 11B is rotated to the right or left about the central axis Z-Z of the low-beam filament 51 and incorporated with a right-traffic automotive headlamp for use in the state shown in FIG. 11A. In contrast, when the bulb in its neutral state shown in FIG. 11B is rotated to the right or left about the central axis Z-Z of the low-beam filament 51 and built into a left-traffic automotive headlamp for use in the state shown in FIG. 11C, the third support wire SW3 and the fourth lead wire LW4 are situated below the lower end 51D of the low-beam filament 51, which gives rise to a problem of the virtual image glare as in the above-described case where the left-traffic light source bulb 5L is used in a right-traffic headlamp.

Thus, in conventional light source bulbs 5, a single (identical) light source bulb 5 cannot be used both as a left-traffic light source bulb 5L and a right-traffic light source bulb 5R. In other words, a left-traffic automotive headlamp uses the left-traffic light source bulb 5L shown in FIGS. 6B, 7, and 8, in the state of FIG. 6C, and a right-traffic automotive headlamp uses the right-traffic light source bulb 5R shown in FIG. 11B, in the state of FIG. 11A.

Moreover, when in the conventional light source bulbs 5L and, 5R described above the lower end SW2' of the vertical bent part on the front end portion of the second support wire SW2 is provided below a product L8 drawn from the lower end 51D of the low-beam filament 51 as shown in FIGS. 6A–6C, 8, and 11A–C, the lower end SW2' of the second support wire SW2 can sometimes be situated below the lower end 51D to produce the problem of the virtual image glare.

Next, description will be made on the glare problem resulting from the glass envelope of the light source bulb 5.

The glass envelope 50 of a light source bulb 5*r* to be used for a right-traffic automotive headlamp has a hollow cylindrical shape, as shown in FIGS. 12A–12D. The rear end part 53 of this glass envelope 50 is sealed at portions on both the right and left sides with respect to the vertical line VU-VD. As shown in FIG. 12A, this results in the central portion 53C of the rear-end sealed part 53 being squeezed into a generally rectangular, planar shape elongated along the vertical line VU-VD as seen from the front. Besides, as shown in FIG. 12C, the portions 53L and 53R on the both right and left sides of this rear-end sealed part 53 are deformed to curve as seen in plan (from the top).

On this account, when the right-traffic light source bulb 5R shown in. FIGS. 12A, C, and D is rotated to the right or left about the central axis Z-Z of the low-beam filament 51 for use as the left-traffic light source bulb shown in FIG. 12B, the curve-deformed portions 53L; and 53R on the left and right are situated up and down. Under the up and down situations of the left and right curve-deformed portions 53L and 53R, the light from the low-beam filament 51 through the middle envelope part (having al flat-shaped cross-section), as shown in FIG. 13, keeps proceeding straight as shown by the arrowed broken line, causing no problem to the low beam distribution pattern LP; in the meantime, the light passing through the left curve-deformed portion 53L situated up changes its optical path as shown by the arrowed full line, which may produce glare on the low beam distribution pattern LP and create a light distribution problem, possibly causing a trouble in terms of the light distribution standards mentioned above.

In order to solve the problem mentioned above, it is therefore contemplated to cover the curve-deformed portions 53L and 53R with a ring-shaped cap 58. The fitting of this cap 58, however, causes another problem described below. That is, lights L10, L20, L30, and L40 from the low-beam filament 51 and high-beam filament 52 are intercepted by the cap 58 with great losses D1 and D2 in the quantity of distributed lights. Incidentally, in FIG. 14, L10 designates the light extending from the corner 51BU formed between the rear end and upper end of the low-beam filament 51 through the corner of the cap 58; L20 the light extending from the corner 51BD formed between the rear end and lower end of the low-beam filament 51 through the corner of the cap 58; L30 the light extending from the corner 52BU formed between the rear end and upper end of the high-beam filament 52 through the corner of the cap 58; L40 the light extending from the corner 52BD formed between the rear end and lower end of the high-beam filament 52 through the corner of the cap 58; D1 the loss area (invalid portion) of the quantity of distributed low beam; and D2 the loss area (invalid portion) of the quantity of distributed high beam. The fitting of the cap 58 also increases the number of component parts, the number of assembling processes and the like, which is undesirable in terms of costs.

The foregoing constitutes the description on the production of the glare problem in the case where a right-traffic light source bulb 5R is built into a left-traffic automotive headlamp for use. Similarly, when the left-traffic light source bulb 5L shown in FIGS. 15A, C, and D is rotated to the right or left about the central axis Z-Z of the low-beam filament 51 for use as a right-traffic light source bulb shown in FIG. 15B, the right and left curve-deformed portions 53R and 53L are also situated up and down to cause the glare problem as described above.

Thus, in conventional light source bulbs 5, a single (identical) light source bulb 5 cannot be used both as a left-traffic light source bulb 5L and a right-traffic light source bulb 5R. In other words, a left-traffic automotive headlamp uses the left-traffic light source bulb 5L in the state of FIG. 12A, and a right-traffic automotive headlamp uses the right-traffic light source bulb 5R in the state of FIG. 15A.

SUMMARY OF THE INVENTION

It is an object of the present-invention to provide a light source bulb in an automotive headlamp, which can be used both as a left-traffic light source bulb and a right-traffic light source bulb.

To achieve the foregoing object, a first invention is characterized in that: in the case where the light source bulb is used as a right-traffic light source bulb and as left-traffic light source bulb, at least one of the lead wires and the support wires situated below the low-beam filament lies in the shading coverage of the high-beam filament when the low-beam filament is lit.

Consequently, due to the configuration described above, the light source bulb of the first invention, even in either use as a right-traffic light source bulb or a left-traffic light source bulb, puts at least one of the lead wires and support wires situated below the low-beam filament into the shading coverage of the high-beam filament in the lighting of the low-beam filament. Therefore, when the low-beam filament is lit, the aforementioned at least one of the lead wires and support wires is prevented from exposure to the irradiating lights from the low-beam filament by the effect of the shading function of the high-beam filament, getting rid of virtual image glare. Moreover, all of the aforementioned lead wires and support wires situated below the low-beam filament can be put into the aforementioned shading coverage of the high-beam filament to surely solve the glare problem.

Besides, in order to achieve the foregoing object, a second invention is characterized in that the boundary between the middle envelope part and the rear-end sealed part of the glass envelope is positioned behind a line connecting the corner formed between the rear end and upper end of the high-beam filament to a corner formed between the reflecting surface of the reflector and the inner periphery of the insertion through-hole.

This results in that: due to the configuration described above, the light source bulb of the second invention, in either use as a right-traffic light source bulb or a left-traffic light source bulb, has the lights from the low-beam filament and high-beam filament reaching the reflecting surface of the reflector without passing through the rear-end sealed part of the glass envelope, even when the right and left curve-deformed portions are situated up and down. This eliminates the optical-path changes in the rear-end sealed part, the production of glare light, and the problem with light distribution. In addition, the lights from the low-beam filament and the high-beam filament reach the entire reflecting surface of the reflector, thereby eliminating the loss in quantity of the low beam and the high beam.

Furthermore, in order to achieve the foregoing object, a third invention is characterized in that the boundary between the middle envelope part and the rear-end sealed part of the glass envelope is positioned behind a line connecting the corner formed between the rear end and upper end of the low-beam filament in its initial state to a corner formed between the reflecting surface of the reflector and the inner periphery of the insertion through hole.

This results in that: due to the configuration described above, the light source bulb of the third invention, in either use as a right-traffic light source bulb or a left-traffic light source bulb, has the lights from the low-beam filament reaching the reflecting surface of the reflector without passing through the rear-end sealed part of the glass envelope, even when the right and left curve-deformed portions are situated up and down. This eliminates the optical-path changes in the rear-end sealed part, the production of glare light, and the problem with light distribution. In addition, the lights from the low-beam filament reach the entire reflecting surface of the reflector, thereby eliminating the loss in quantity of the low beam.

Thus, the light source bulbs of the present invention can be used both as a left-traffic light source bulb and a right-traffic light source bulb in one.

The nature, principle and utility of the invention will become more apparent from the following detailed description when read in conjunction with the accompanying drawings.

BRIEF DESCRIPTION OF THE DRAWINGS

In the accompanying drawings:

FIG. 15C is a view taken along the arrow C in. FIG. 15A, and FIG. 15D is a view taken along the arrow D in FIG. 15A;

DETAILED DESCRIPTION OF THE PREFERRED EMBODIMENTS

Figure 1:
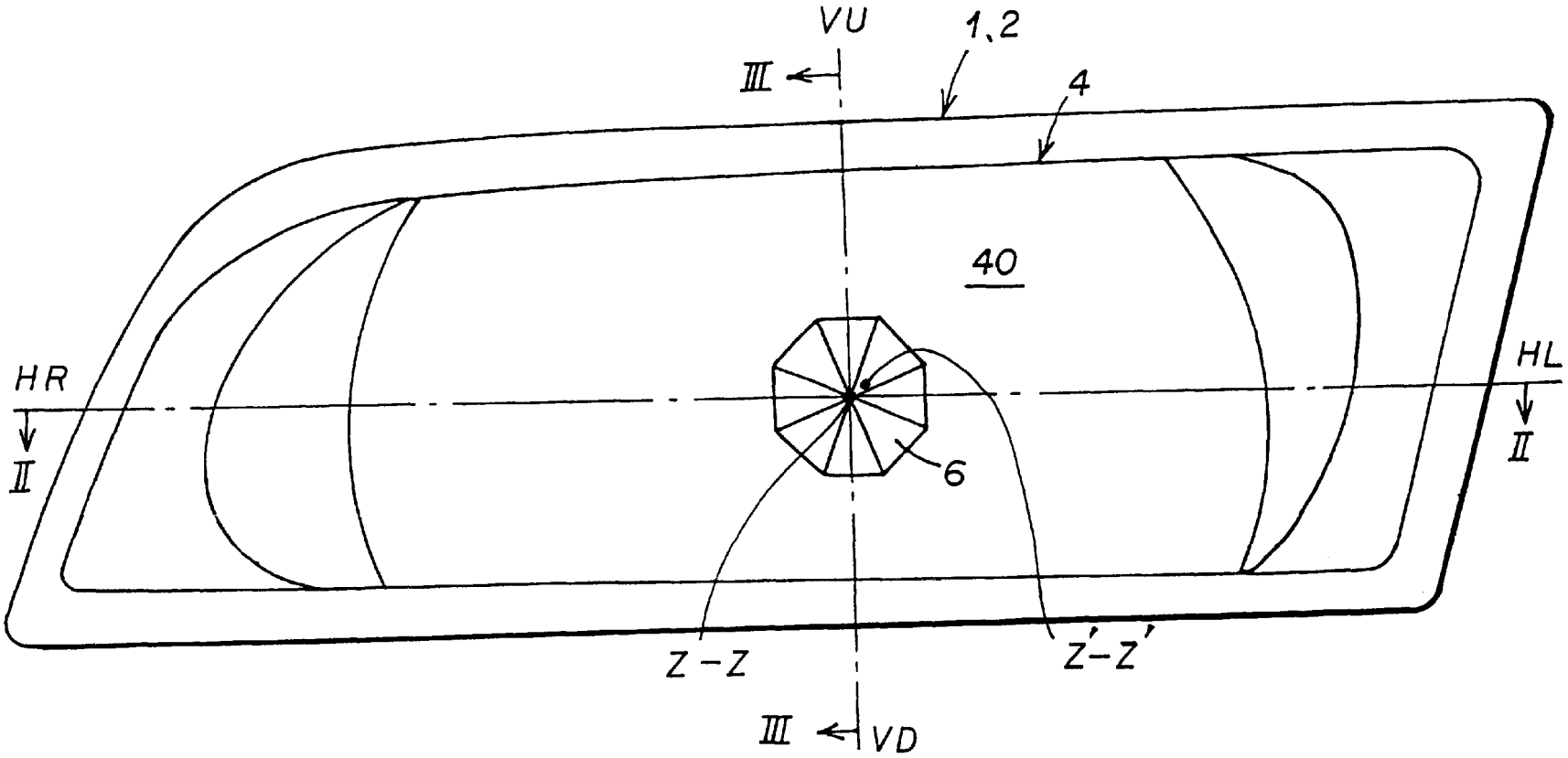
FIG. 1 PRIOR ART
FIG. 1 is a front view showing an automotive headlamp using a conventional light source bulb, the reflecting surface and the shade of its reflector being seen through a lens.
Figure 2:
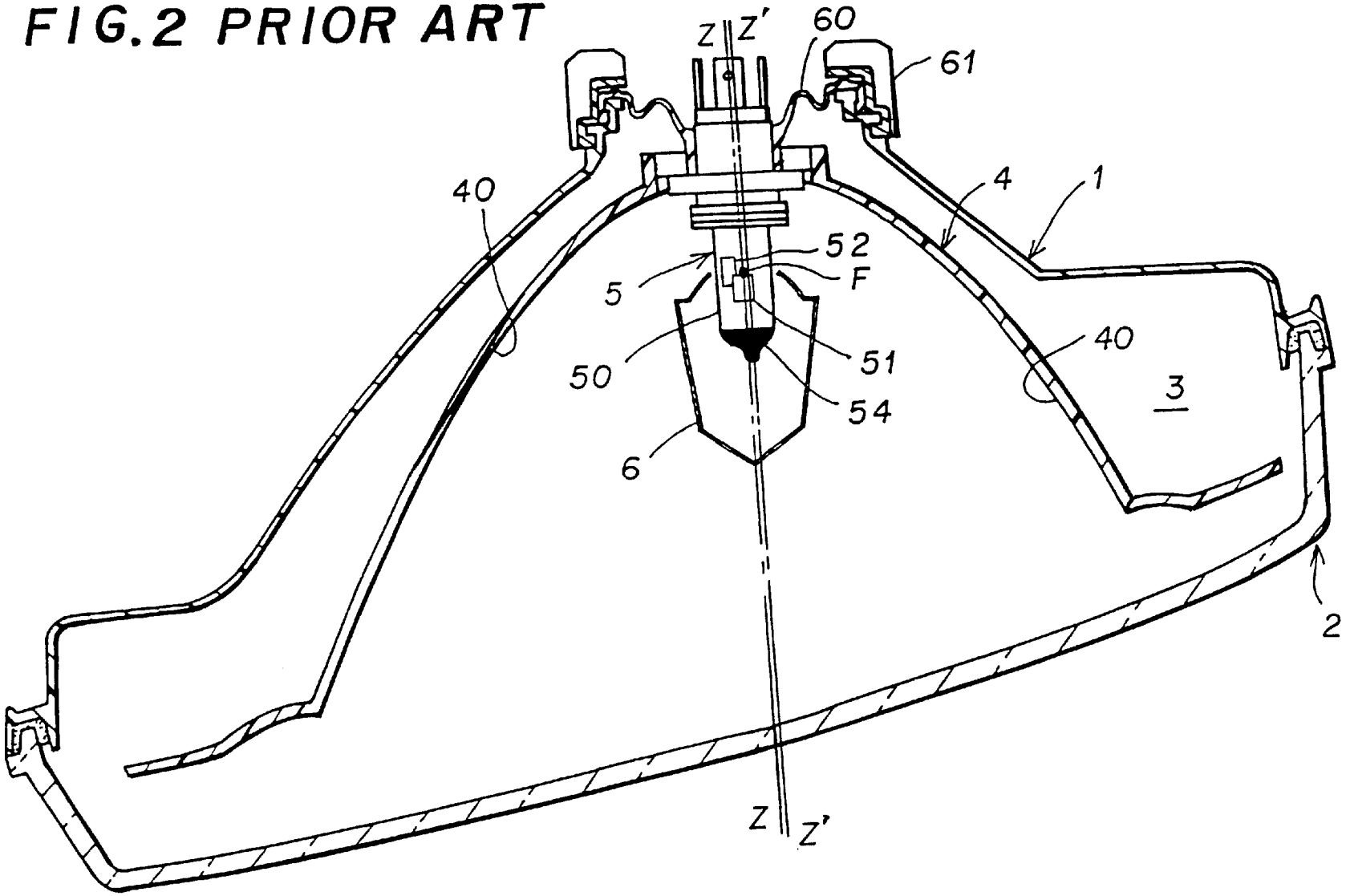
FIG.2 PRIOR ART
FIG. 2 is a sectional view on the line II—II in FIG. 1.
Figure 3:
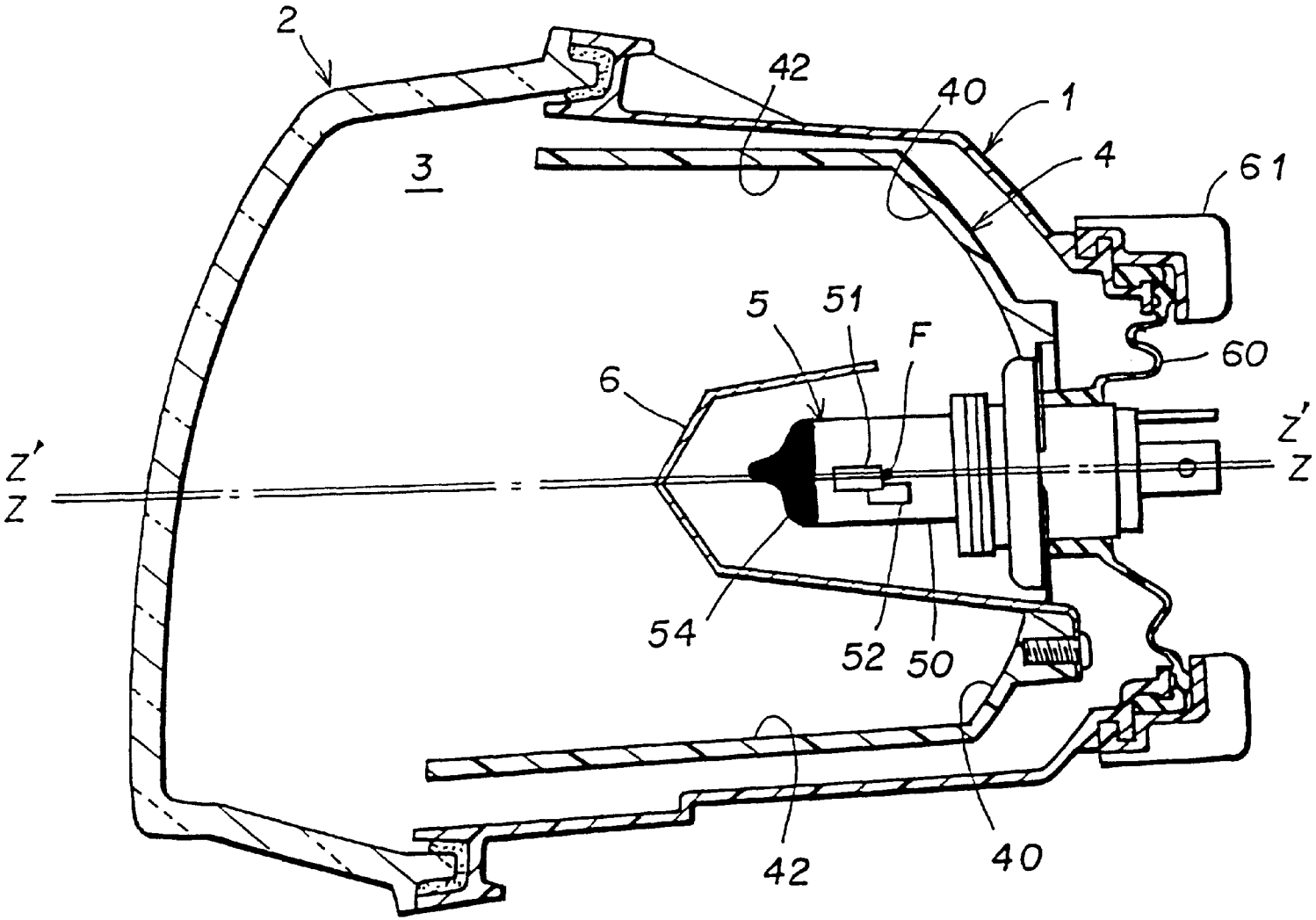
FIG.3 PRIOR ART
FIG. 3 is a sectional view on the line III—III in FIG. 1.
Figure 4:
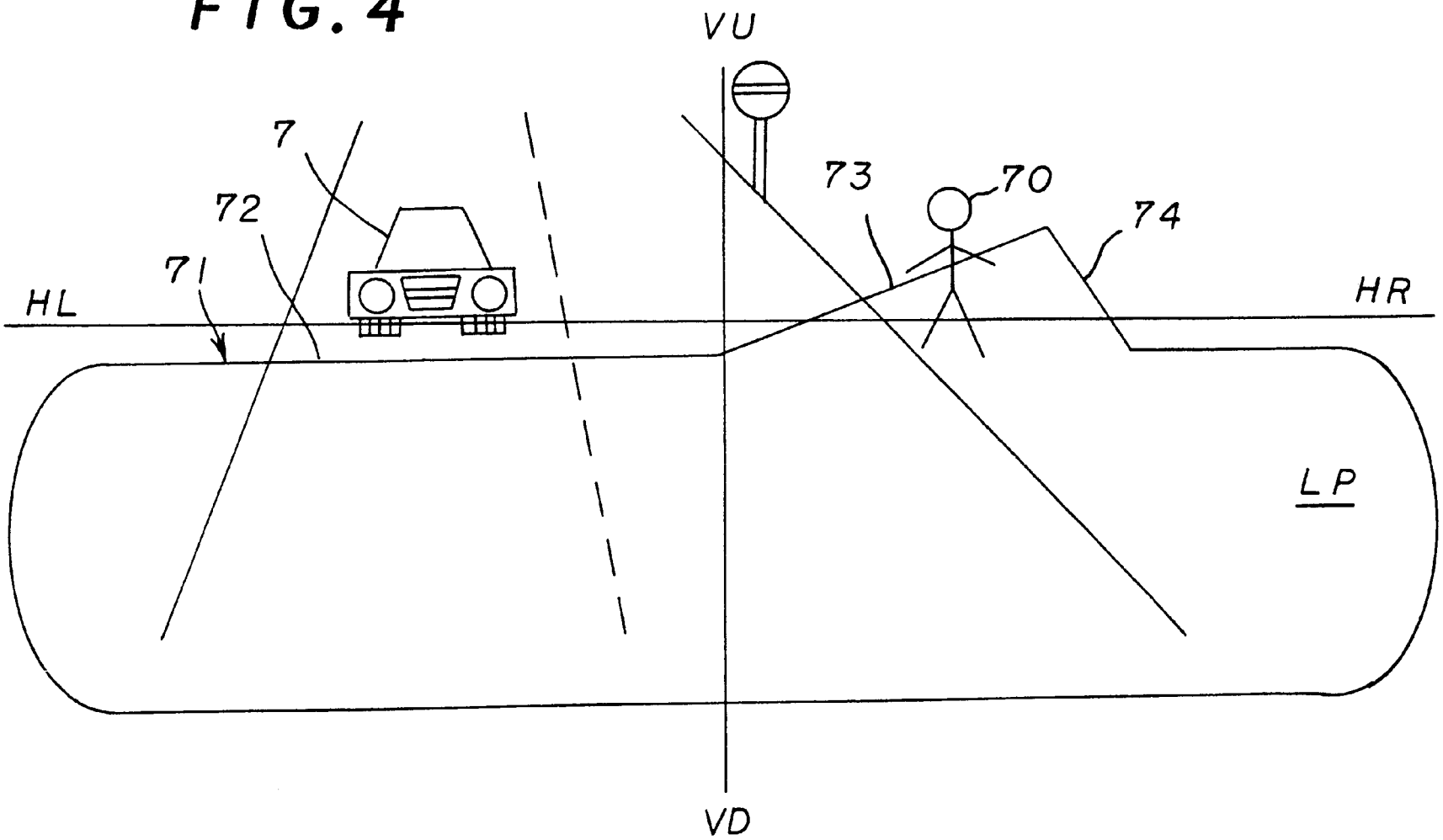
PRIOR ART FIG. 4
FIG. 4 is an image diagram of a low beam distribution pattern.
Figure 5:
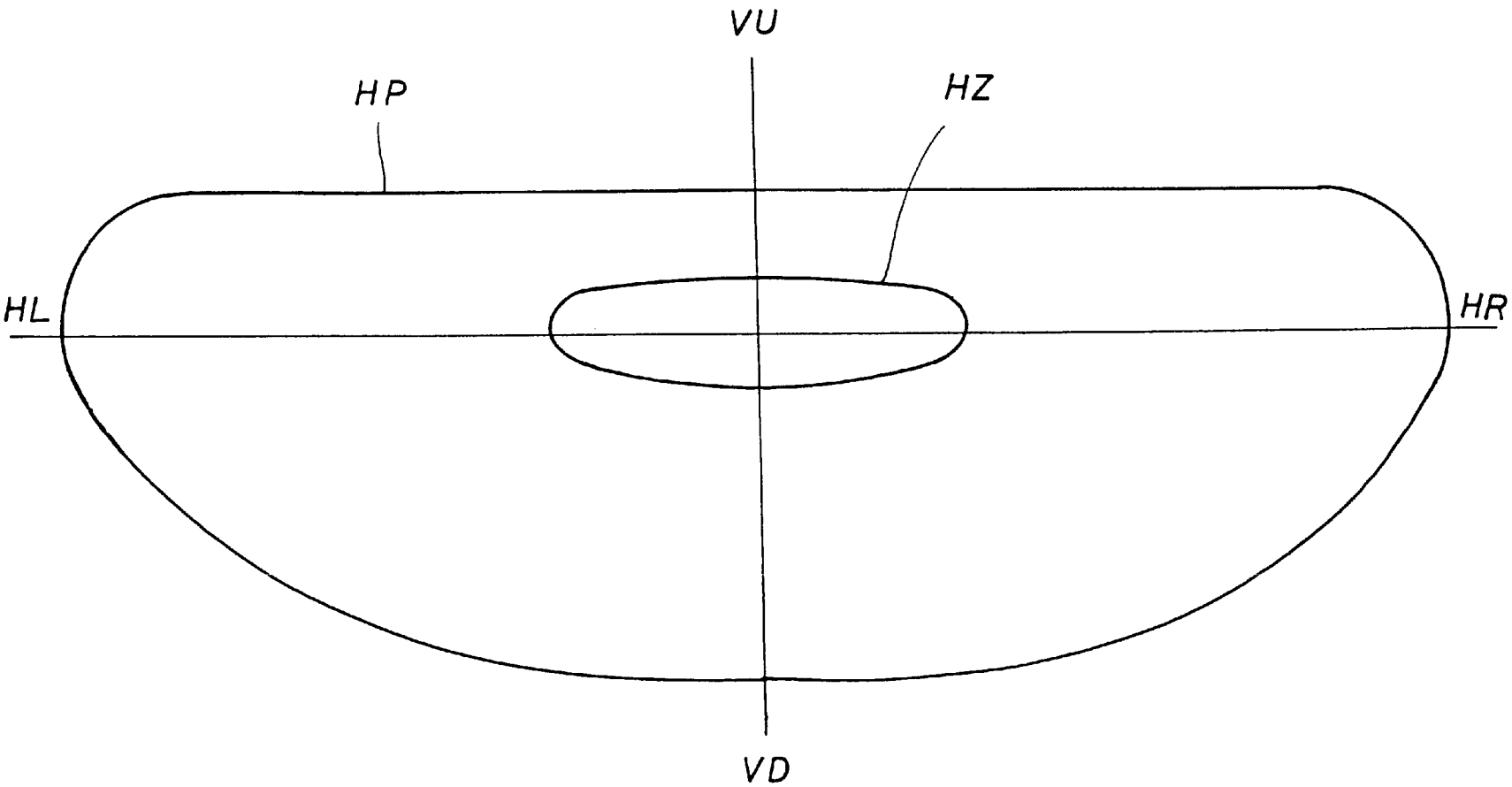
PRIOR ART FIG. 5
FIG. 5 is an image diagram of a high beam distribution pattern.
Figure 6A:
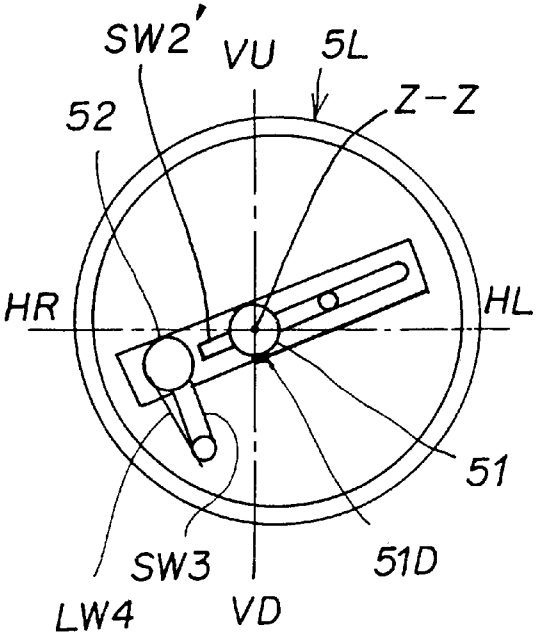
FIG.6A PRIOR ART
FIG. 6A is a front view of a conventional left-traffic light source bulb being used as a right-traffic light source bulb.
Figure 6B:
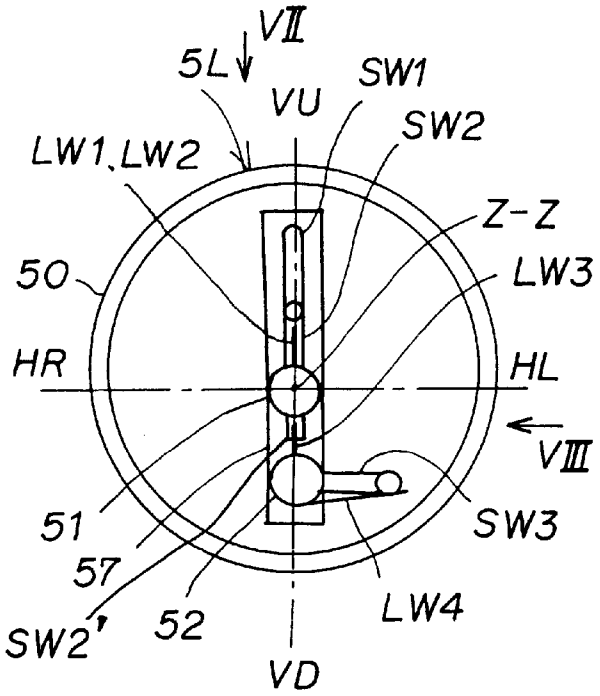
FIG.6B PRIOR ART
FIG. 6B is a front view of the conventional left-traffic light source bulb in its neutral state.
Figure 6C:
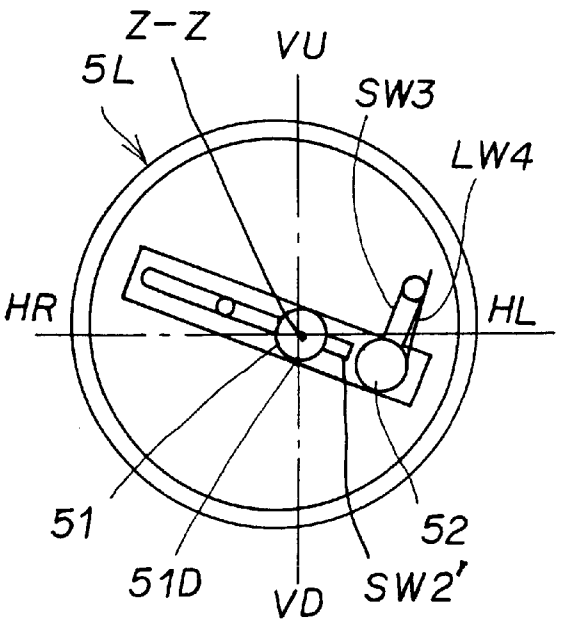
FIG.6C PRIOR ART
FIG. 6C is a front view of the conventional left-traffic light source bulb in use.
Figure 7:
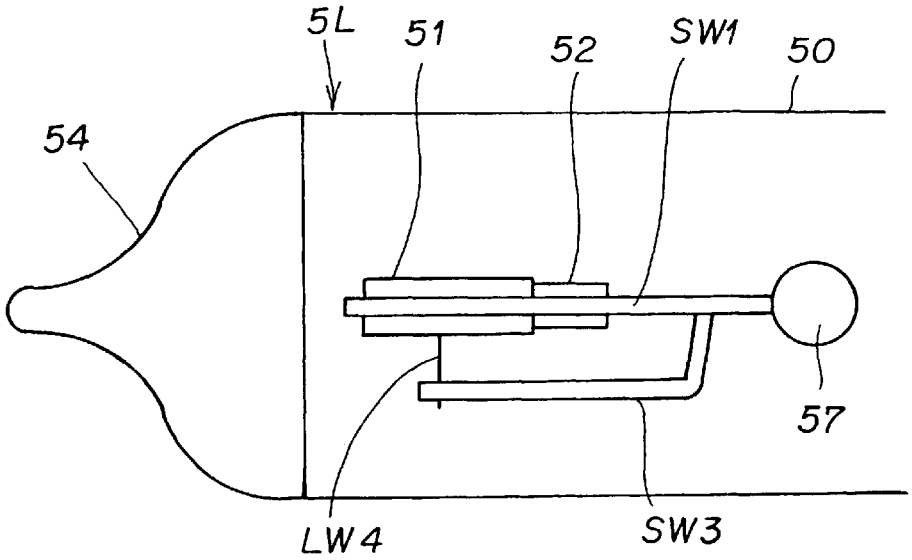
FIG.7 PRIOR ART
FIG. 7 is a view (plan view) taken along the arrow VII in FIG. 6B.
Figure 8:
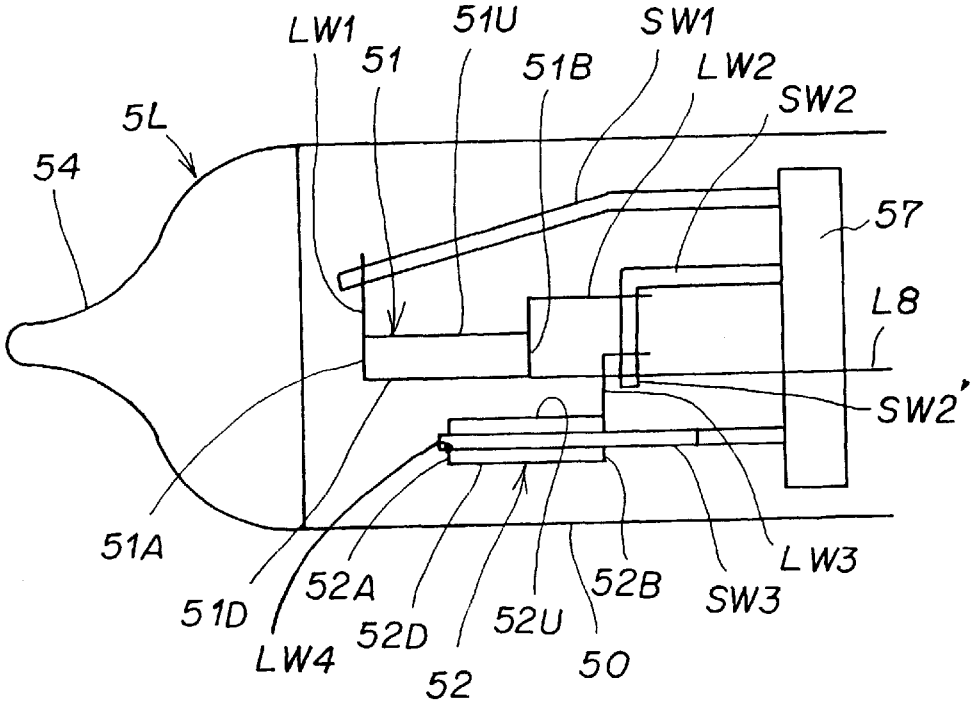
FIG.8 PRIOR ART
FIG. 8 is a view (side view) taken along the arrow VIII in FIG. 6B.
Figure 9:
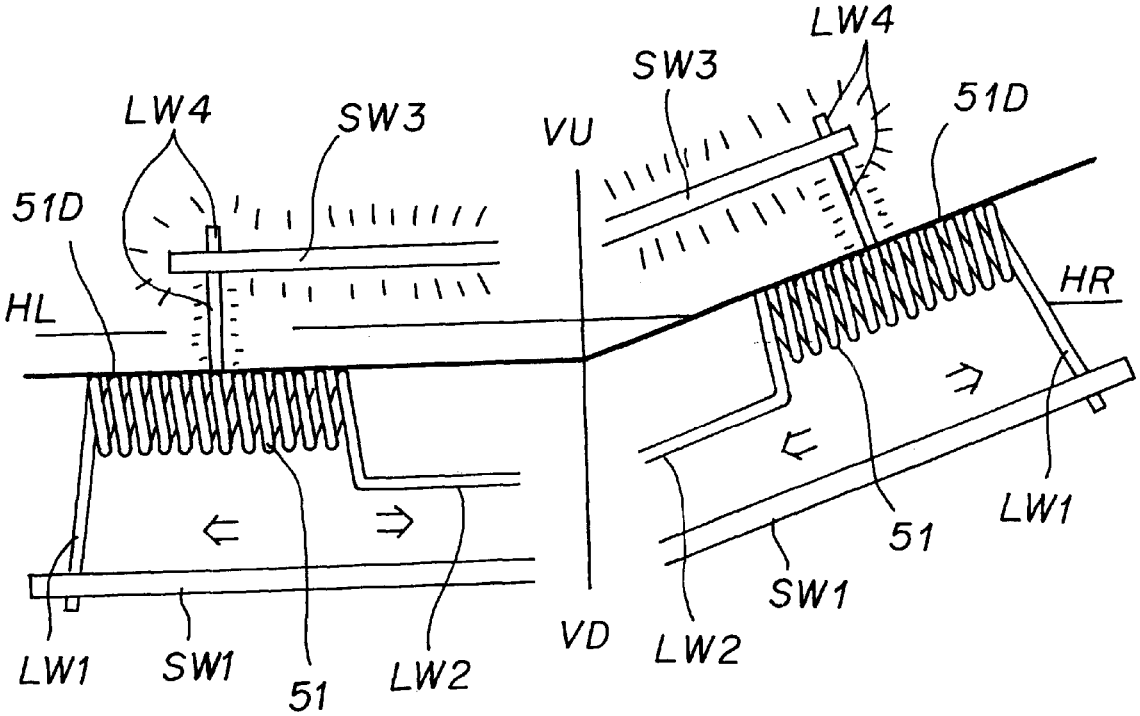
FIG.9 PRIOR ART
FIG. 9 is a screen image diagram for explaining the virtual image glare caused by a conventional light source bulb.
Figure 10:
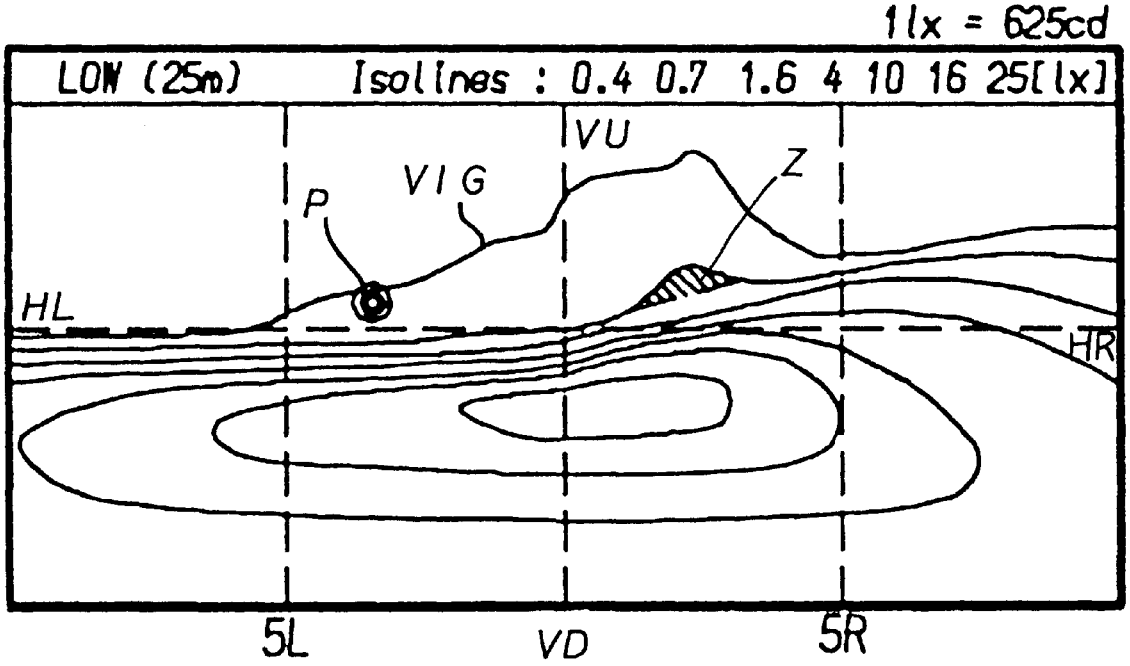
FIG.10 PRIOR ART
FIG. 10 is an iso-luminance chart in the case where a conventional left-traffic light source bulb is used as a right-traffic light source bulb, the diagram showing virtual image glare distributed over the point and zone where glare is severely restricted by the European light distribution standards ECE Reg.
Figure 11A:
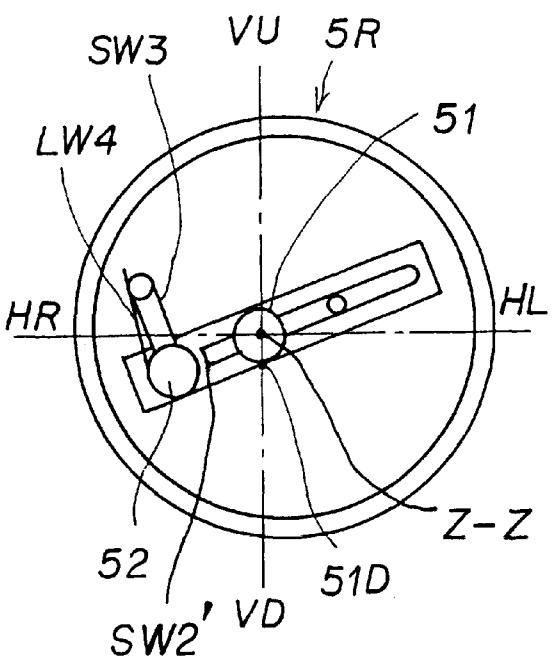
FIG.11A PRIOR ART
FIG. 11A is a front view of a conventional right-traffic light source bulb in use.
Figure 11B:
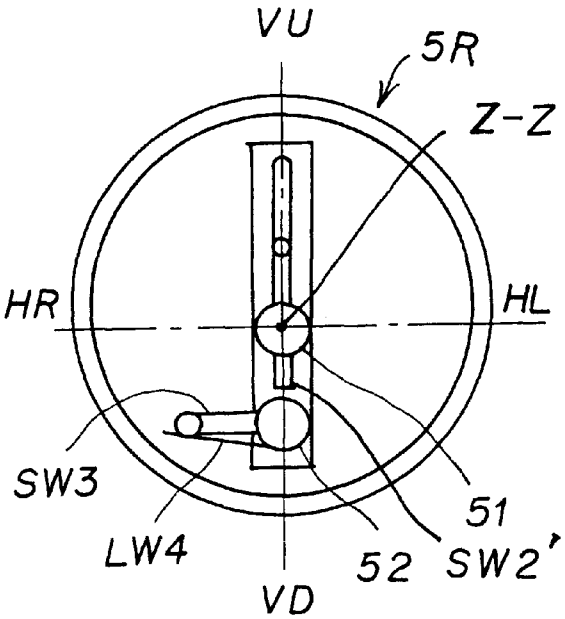
FIG.11B PRIOR ART
FIG. 11B is a front view of the conventional right-traffic light source bulb in its neutral state.
Figure 11C:
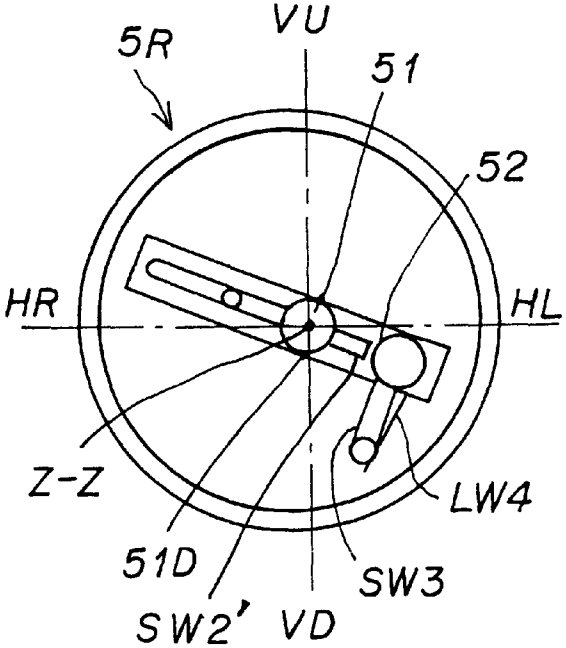
FIG.11C PRIOR ART
FIG. 11C is a front view of the conventional right-traffic light source bulb being used as a left-traffic light source bulb.
Figure 12A:
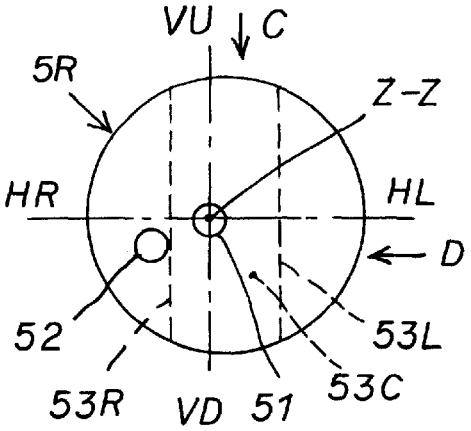
PRIOR ART FIG.12A
FIG. 12A is a front view of a conventional right-traffic light source bulb.
Figure 12B:
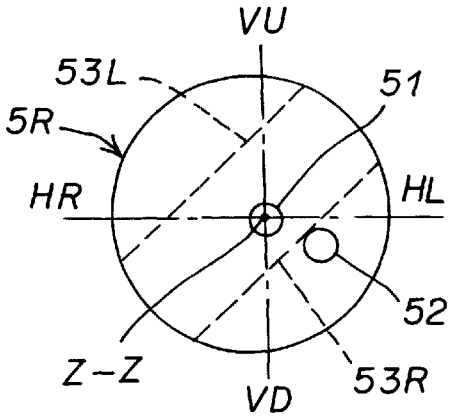
PRIOR ART FIG.12B
FIG. 12B is a front view of the conventional right-traffic light source bulb being situated as a left-traffic light source bulb.
Figure 12C:
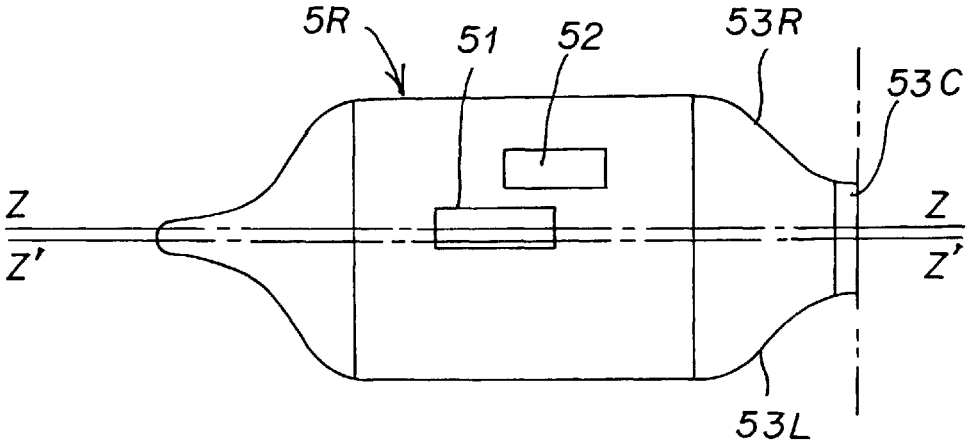
PRIOR ART FIG.12C
FIG. 12C is a view taken along the arrow C in FIG. 12A.
Figure 12D:
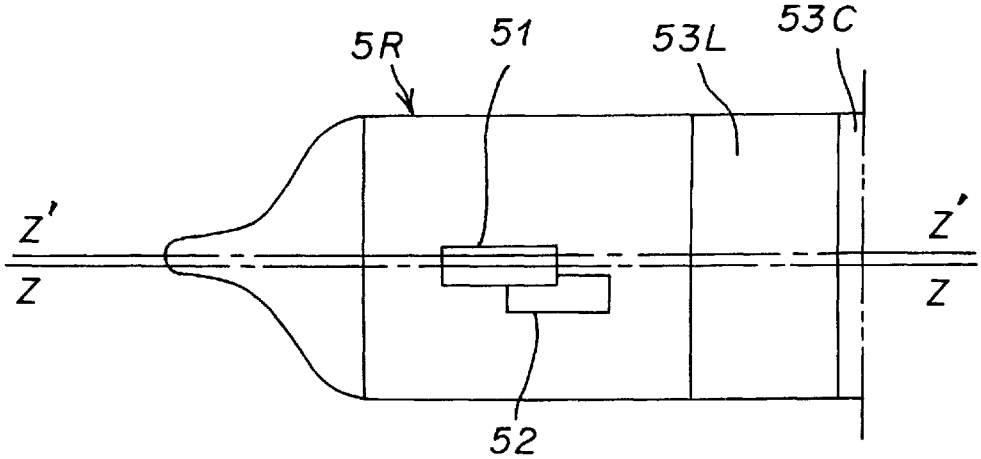
PRIOR ART FIG.12D
FIG. 12D is a view taken along the arrow D in FIG. 12A.
Figure 13:
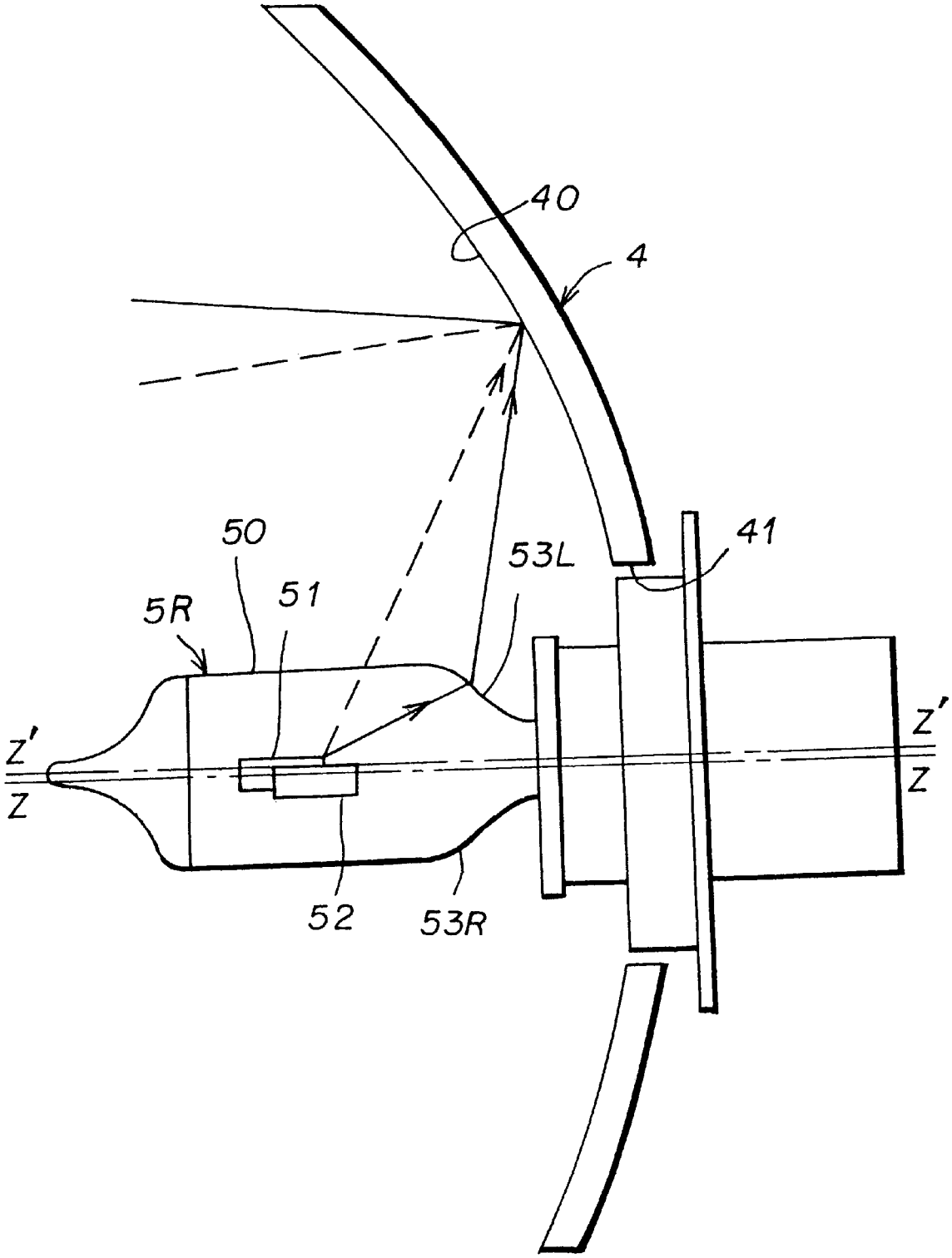
FIG.13 PRIOR ART
FIG. 13 is a partial longitudinal sectional view showing the problem in the case where a conventional right-traffic light source bulb is used as a left-traffic light source bulb.
Figure 14:
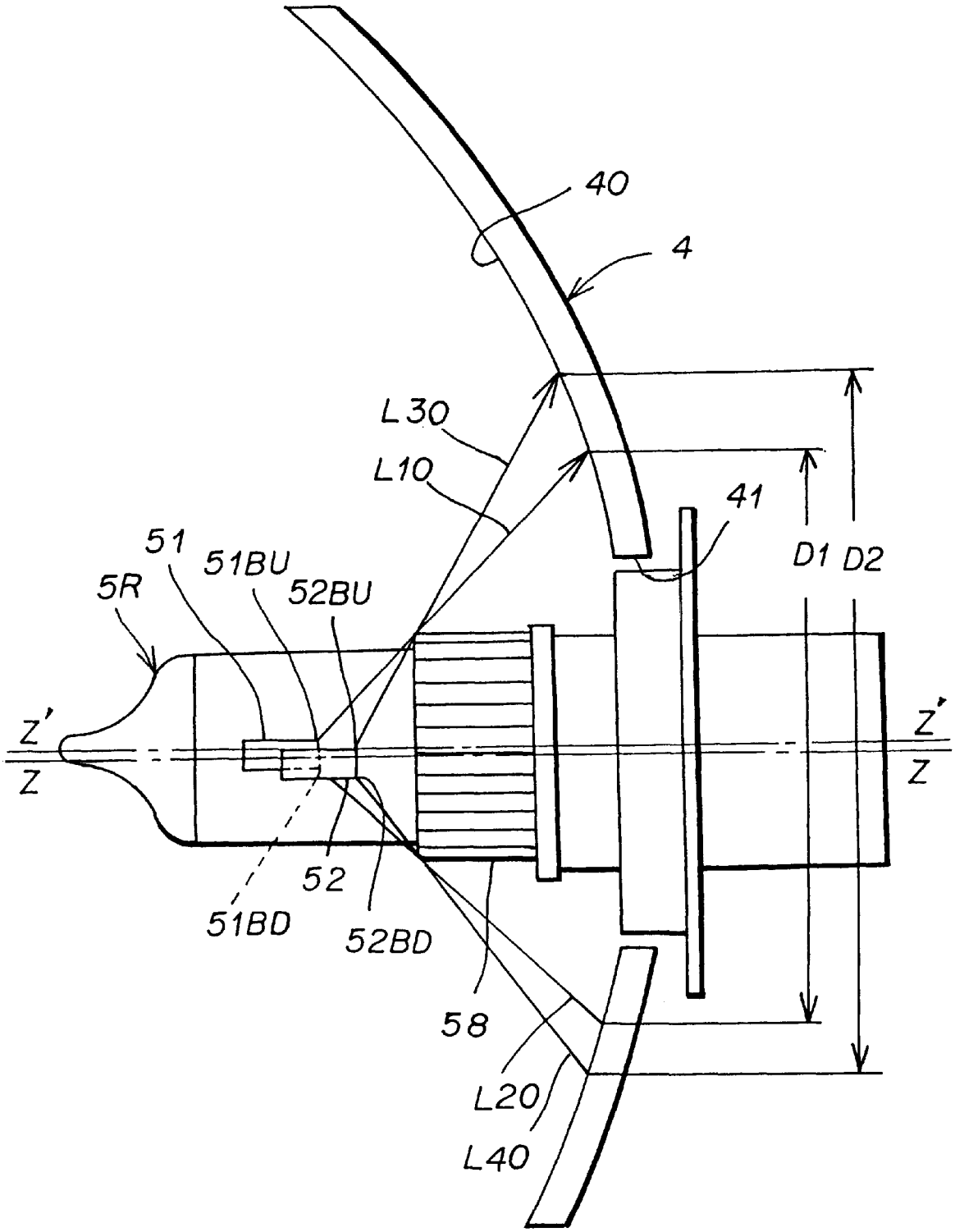
FIG.14 PRIOR ART
FIG. 14 is a partial longitudinal sectional view showing the problem in the case a cap is fit to the same.
Figure 15A:
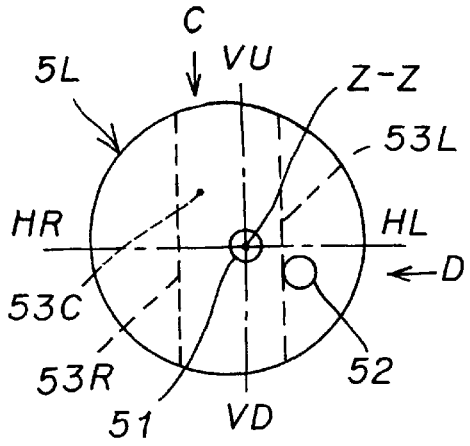
PRIOR ART FIG.15A
FIG. 15A is a front view of a conventional left-traffic light source bulb.
Figure 15B:
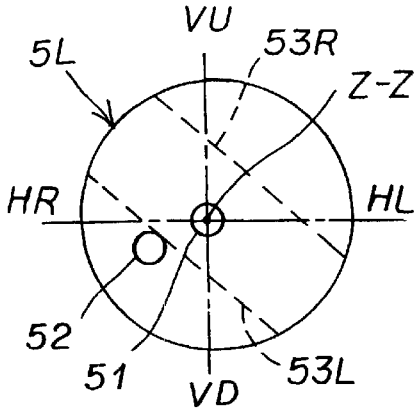
PRIOR ART FIG.15B
FIG. 15B is a front view of the conventional left-traffic light source bulb being situated as a right-traffic light source bulb.
Figure 15C:
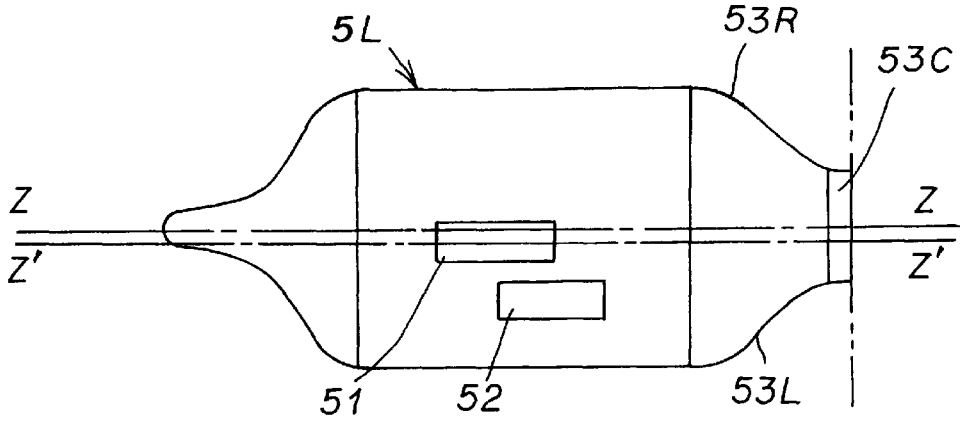
PRIOR ART FIG.15C
Figure 15D:
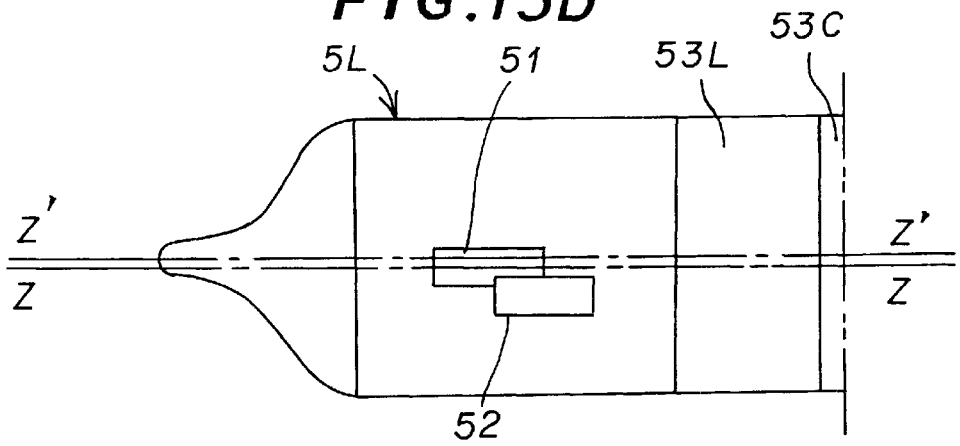
PRIOR ART FIG.15D

Hereinafter, embodiments of the light source bulbs of the present invention will be described with reference to FIGS. 16 through 30B. In the drawings, like numerals or symbols of those in FIGS. 1 through 15D designate like parts.

FIGS. 16 through 27B show an embodiment of the light source bulb of the first invention.

Figure 16:
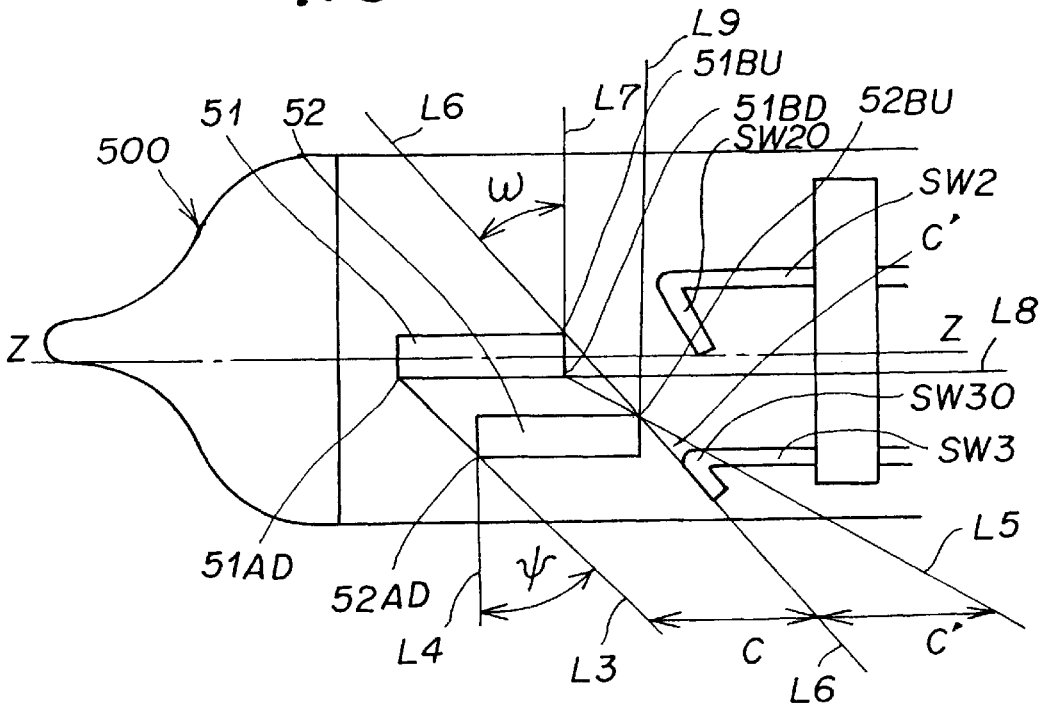
FIG. 16 is a side view showing an embodiment of the light source bulb of the first invention in its neutral state, for explaining the arrangement of the fourth lead wire, the third support wire, and the second support wire.
Figure 17:
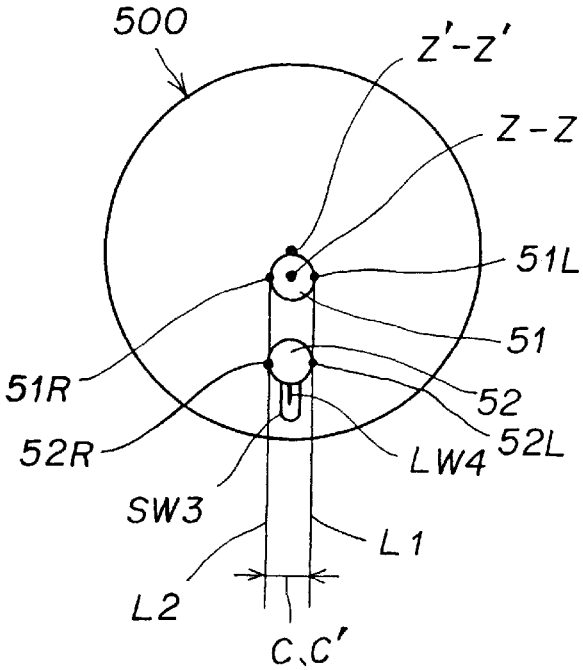
FIG. 17 is a front view of the same in its neutral state, for explaining the arrangement of the fourth lead wire and the third support wire.
Figure 18:
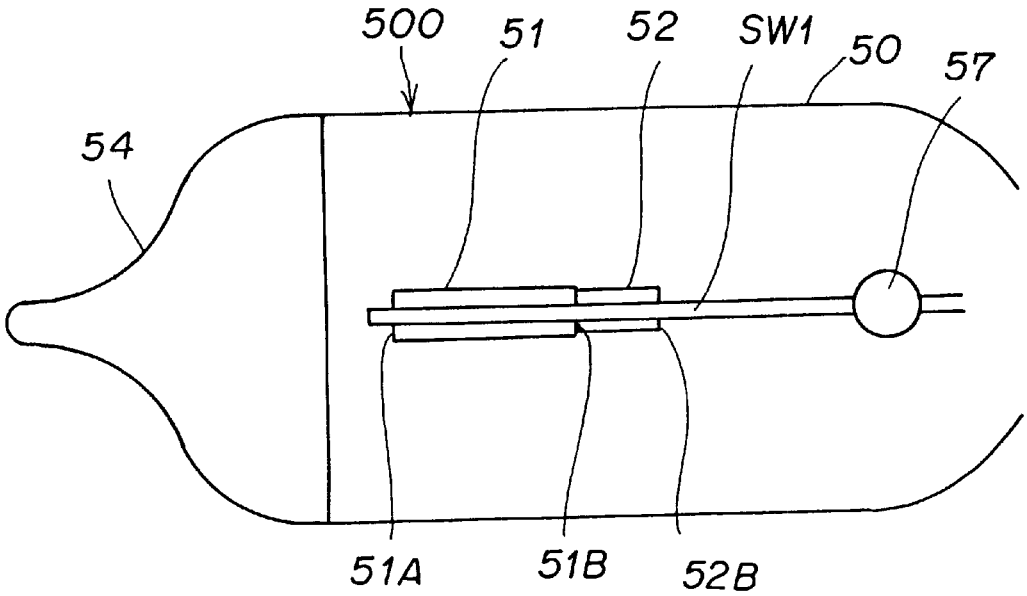
FIG. 18 is a plan view showing the same in its neutral state, for explaining the arrangement of lead wires and support wires.

As shown in FIGS. 16 and 17, a light source bulb 500 of the first invention in this embodiment includes a fourth lead wire LW4, a third support wire SW3, and a second support wire SW2 which are arranged under the conditions described below.

Firstly, the fourth lead wire LW4:

as the light source bulb 500 in its neutral state is viewed from the front, is arranged between a line L1 drawn from the left end 51L of the low-beam filament 51 through the left end 52L of the high-beam filament 52 and a line L2 drawn from the right end 51R of the low-beam filament 51 through the right end 52R of the high-beam filament 52; and, as the light source bulb 500 in its neutral state is viewed from a side, is extended from the front end 52A to rearward of the high-beam filament 52 through below the same and positioned behind a line L3 drawn from the corner 51AD formed between the front end 51A and lower end 51D of the low-beam filament 51 through the corner 52AD formed between the front end 52A and lower end 52D of the high-beam filament 52. In other words, the bent portion LW40 on the front end of the fourth lead wire LW4 has a bend angle greater than the angle ψ formed between the above-described line L3 and a line L4 (a line being perpendicular to the optical axis Z-Z and drawn through the front end 52A of the high-beam filament 52). In this example the bend angle is set to ψ.

Next, the third support wire SW3:

as the light source bulb 500 in its neutral state is viewed from the front, is arranged between the line L1 drawn from the left end 51L of the low-beam filament 51 through the left end 52L of the high-beam filament 52 and the line L2 drawn from the-right end 51R of the low-beam filament 51 through the right end 52R of the high-beam filament 52; and, as the light source bulb 500 in the neutral state is viewed from a side, is bent to a curved surface at its portion SW30 forward of a line L5 drawn from the corner 51BD formed between the rear end 51B and lower end 51D of the low-beam filament 51 through the corner 52BU formed between the rear end 52B and upper end 52U of the high-beam filament 52, the curved surface diffusing lights from the low-beam filament 51. In other words, the bent portion SW30 on the front end of the third support wire SW3 has a bend angle greater than the angle ω formed between a line L6 (a line being drawn, in the side view, from the corner 51BU formed between the rear end 51B and upper end 51U of the low-beam filament 51 through the corner 52BU formed between the rear end 52B and upper end 52U of the high-beam filament 52) and a line L7 (a line being perpendicular to the optical axis Z-Z and drawn through the rear end 51B of the low-beam filament 51). In this example the bend angle is set to ω, and the front portion SW30 of the third support wire LW3 is placed between the line L5 and the line L6.

Finally, the second support wire SW2, as the light source bulb 500 in the neutral state is viewed from a side, has a front end portion SW20 which is bent at an acute angle to rearward of the rear end 52B of the high-beam filament 52 (or a line L9 being perpendicular to the optical axis Z-Z and drawn through the rear end 52B of the high-beam filament 52) and positioned above a line L8 drawn from the lower end 51D of the low-beam filament 51.

Figure 19:
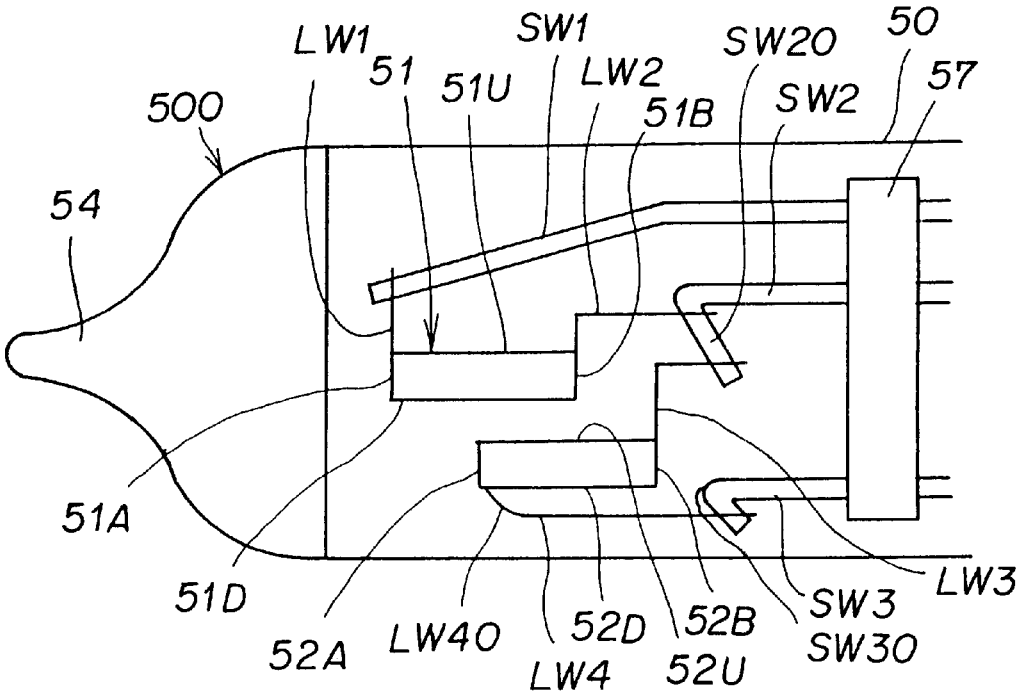
FIG. 19 is a side view showing the same in its neutral state, for explaining the arrangement of the lead wires and the support wires.

Here, the rear end of the third support wire SW3 is fixed to the lowest mountable portion of a bridge 57 as shown in FIGS. 16 and 19. When fixed to the bridge 57, the rear ends of the first, second, and third support wires SW1, SW2, and SW3 cannot be placed so close to each other, in terms of manufacture of the light source bulb.

The light source bulb 500 of the first invention in this embodiment has the configuration as described above. Hereinafter, description will be made on the function thereof.

Figure 20A:
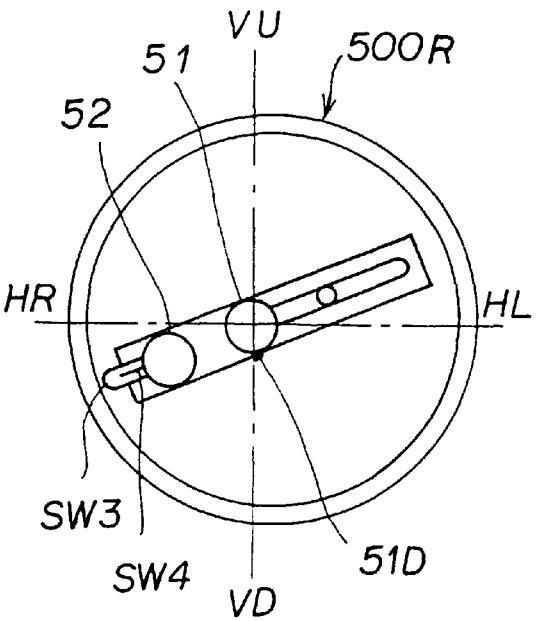
FIG. 20A is a front view of a light source bulb of the first invention being used as a right-traffic light source bulb.
Figure 20B:
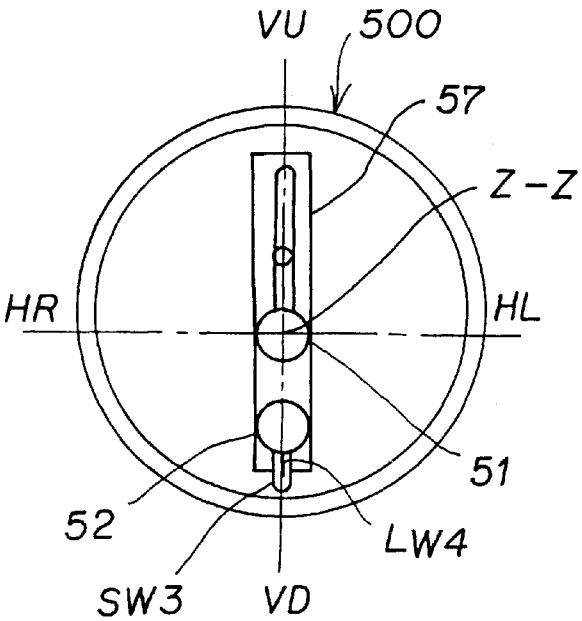
FIG. 20B is a front view of the light source bulb of the first invention in its neutral state.
Figure 20C:
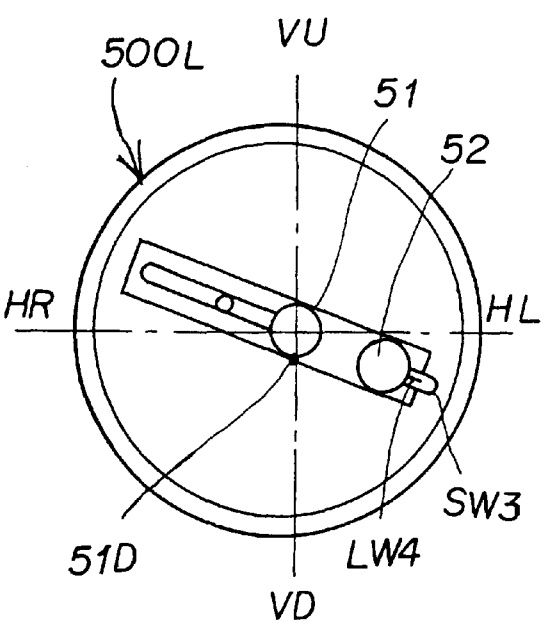
FIG. 20C is a front view of the light source bulb of the first invention being used as a left-traffic light source bulb.

First, when the light source bulb 500 of the first invention in its neutral state of FIG. 20B (the state where the low-beam filament 51 and the highs-beam filament 52 are on VU-VD) is rotated to the left and right about the central axis Z-Z of the low-beam filament 51 for use as a light source bulb 500R of FIG. 20A for a right-traffic automotive headlamp (where the high-beam filament 52 is situated at the lower rightward of the low-beam filament 51) and as a light source bulb 500L of FIG. 20C for a left-traffic automotive headlamp (where the high-beam filament 52 is situated at the lower leftward of the low-beam filament 51), respectively, the third support wire SW3 and the fourth lead wire LW4 can sometimes be situated below the lower end 51D of the low-beam filament 51 as shown in FIGS. 20A and 20C. Even in such cases, a considerable part of the fourth lead wire LW4 ranging from the front end to the rear end thereof lies in the shading coverage C, which is defined, as shown in FIG. 17, between the product L1 drawn from the left end 51L of the low-beam filament 51 through the left end 52L of the high-beam filament 52 in the front view and the product L2 drawn from the right end 51R of the low-beam filament 51 and the right end 52R of the high-beam filament 52 in the front view. The shading coverage C is further defined, as shown in FIG. 16, between the product L3 drawn from the corner 51AD formed between the front end 51A and lower end 51D of the low-beam filament 51 through the corner 52AD formed between the front end 52A and lower end 52D of the high-beam filament 52 in the side view and the line L6 drawn from the corner 51BU formed between the rear end 51B and upper end 51U of the low-beam filament 51 and the corner 52BU formed between the rear end 52B and upper end 52U of the high-beam filament 52 in the side view. Therefore, when the low-beam filament 51 is lit, the considerable part of the fourth lead wire LW4 is prevented from exposure to the irradiating lights from the low-beam filament 51 by the effect of the shading function of the high-beam filament 52. Thereby virtual image glare is avoided.

Meanwhile, the front end of the third support wire SW3 has the curved-surface bent portion SW30 put in the semi-shading coverage C' , which is defined, as shown in FIG. 17, between the line L1 drawn from the left end 51L of the low-beam filament 51 through the left end 52L of the high-beam filament 52 in the front view and the line L2 drawn from the right end 51R of the low-beam filament 51 and the right end 52R of the high-beam filament 52 in the front view. The semi-shading coverage C' is further defined, as shown in FIG. 16, between the line L5 drawn from the corner 51BD formed between the rear end 51B and lower end 51D of the low-beam filament 51 through the corner 52BU formed between the rear end 52B and upper end 52U of the high-beam filament 52 in the side view and the line L6 drawn from the corner 51BU formed between the rear end 51B and upper end 51U of the low-beam filament 51 through the corner 52BU formed between the rear end 52B and upper end 52U of the high-beam filament 52 in the side view. Thus, when the low-beam filament 51 is lit, the portion SW30 does receive the irradiating lights from the low-beam filament 51 but merely with a minute area. This combines with the light diffusing function of the bending curved-surface to get rid of virtual image glare.

In addition, even though the third support wire SW3 receives the irradiating lights of the low-beam filament 51 with the portion rearward of the semi-shading coverage C' (the line L5) when the low-beam filament 51 is lit, the portion are not appearing to shine as seen from the reflecting surface 40 of the reflector 4 due to the incident and reflection angles of the irradiating lights from the low-beam filament 51, thereby getting rid of virtual image glare.

Further, as shown in FIGS. 16 and 17, the second support wire SW2 lies above the line L8 drawn from the lower end 51D of the low-beam filament 51, thereby getting rid of virtual image glare.

Moreover, the front end portion SW20 of the second support wire SW2 is bent at an acute angle to rearward of the rear end 52B of the high-beam filament 52 (the line L9), so that the front end portion SW20 of the second support wire SW2 recedes from the filament (low-beam filament 51) to reduce the quantity of irradiation from the filament and the area of exposure, getting rid of virtual image glare by that extent.

Accordingly, the single light source bulb 500 of the first invention in this embodiment can be used both as the left-traffic light source bulb 500L shown in FIG. 20C and the right-traffic light source bulb 500R shown in FIG. 20A in one.

Figure 21:
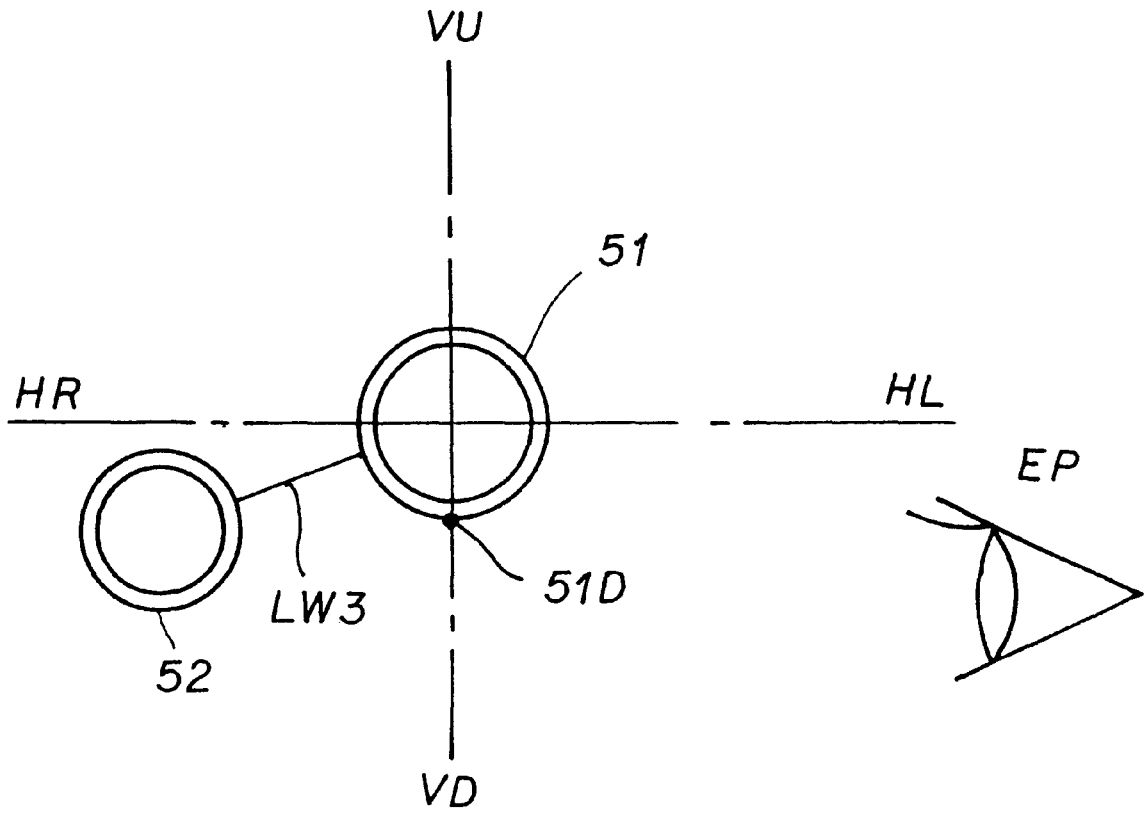
FIG. 21 is a front view for illustrating the third lead wire of the light source bulb not appearing.

In the light source bulb 500 of the first invention of this embodiment, the third lead wire LW3 exists, as shown in FIG. 19, in a position exposed to the irradiating lights from the low-beam filament 51 when the low-beam filament 51 is lit. In serving as the left-traffic light source bulb 500L or the right-traffic light source bulb 500R, however, the third lead wire LW3, as shown in FIG. 21, is hardly seen from the maximum intensity forming portion (omitted of illustration) on the reflecting surface 40 of the reflector 4 which distributes virtual image glare. Even if seen partly, since situated higher than the lower end 51D of the low-beam filament 51, the third lead wire LW3 is off the point (zone) where glare is severely restricted by the European light distribution standards ECE Reg., thereby causing no problematic virtual-image glare.

Moreover, in the light source bulb 500 of the first invention in this embodiment, the front end portion SW20 of the second support wire SW2 is folded to provide a larger welding area for the third lead wire LW3, so that a sufficient welding strength is obtained.

Figure 22:
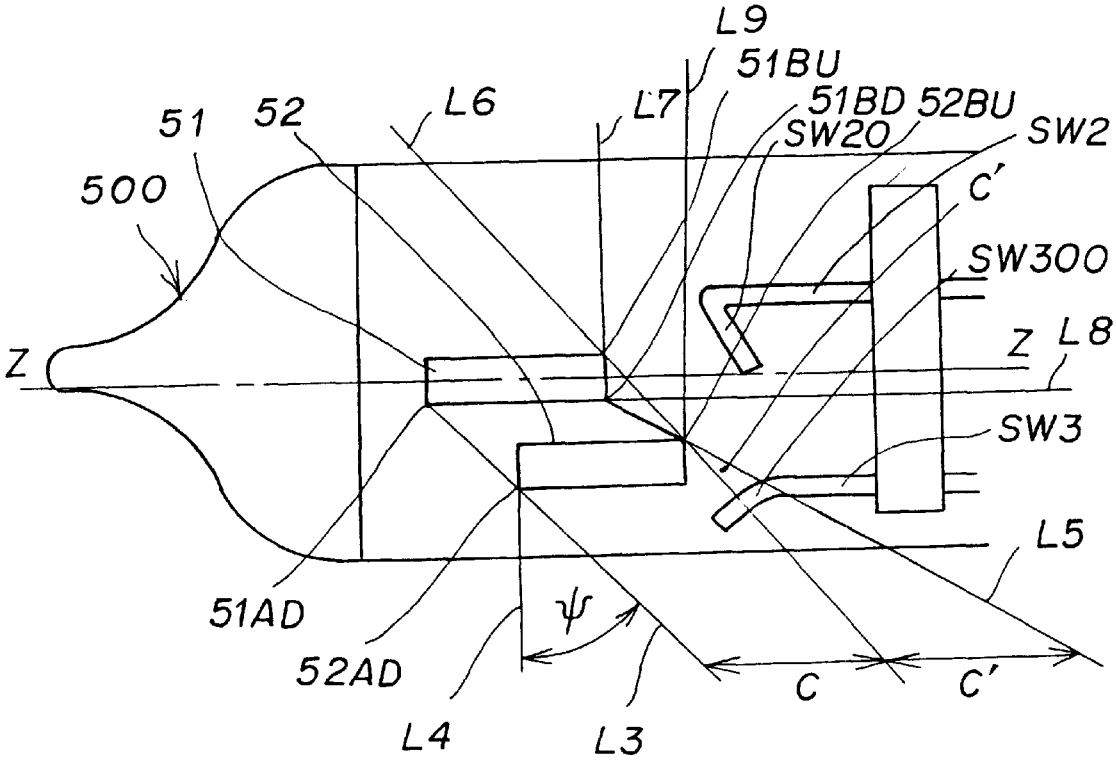
FIG. 22 is a side view of a light source bulb in its neutral state, for explaining a variation example on the arrangement of the fourth lead wire, the third support wire, and the second support wire.
Figure 23:
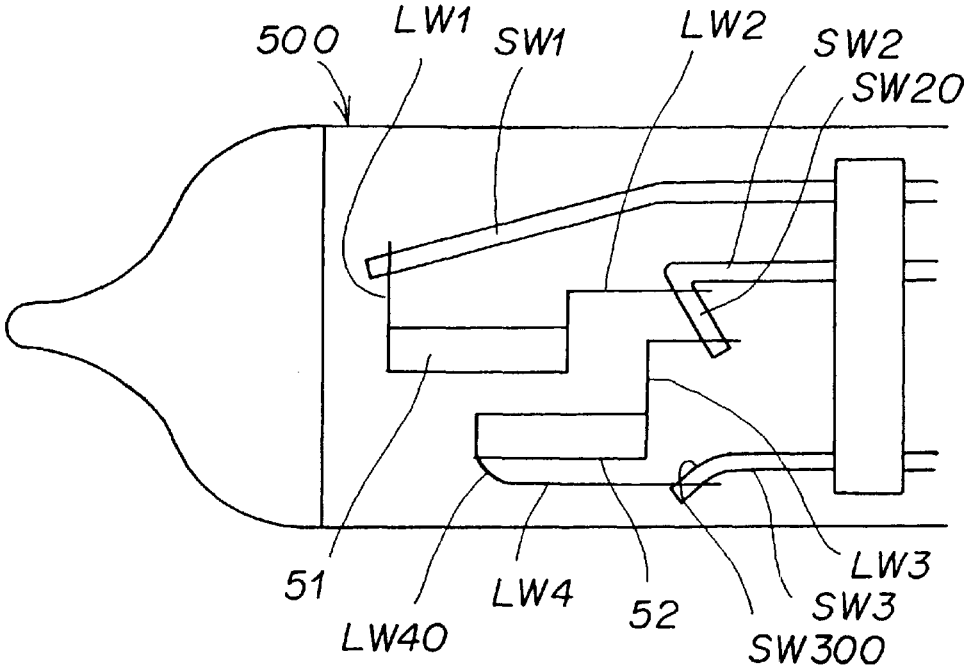
FIG. 23 is a side view of a light source bulb in its neutral state, for explaining a variation example on the arrangement of the lead wires and the support wires.
Figure 24:
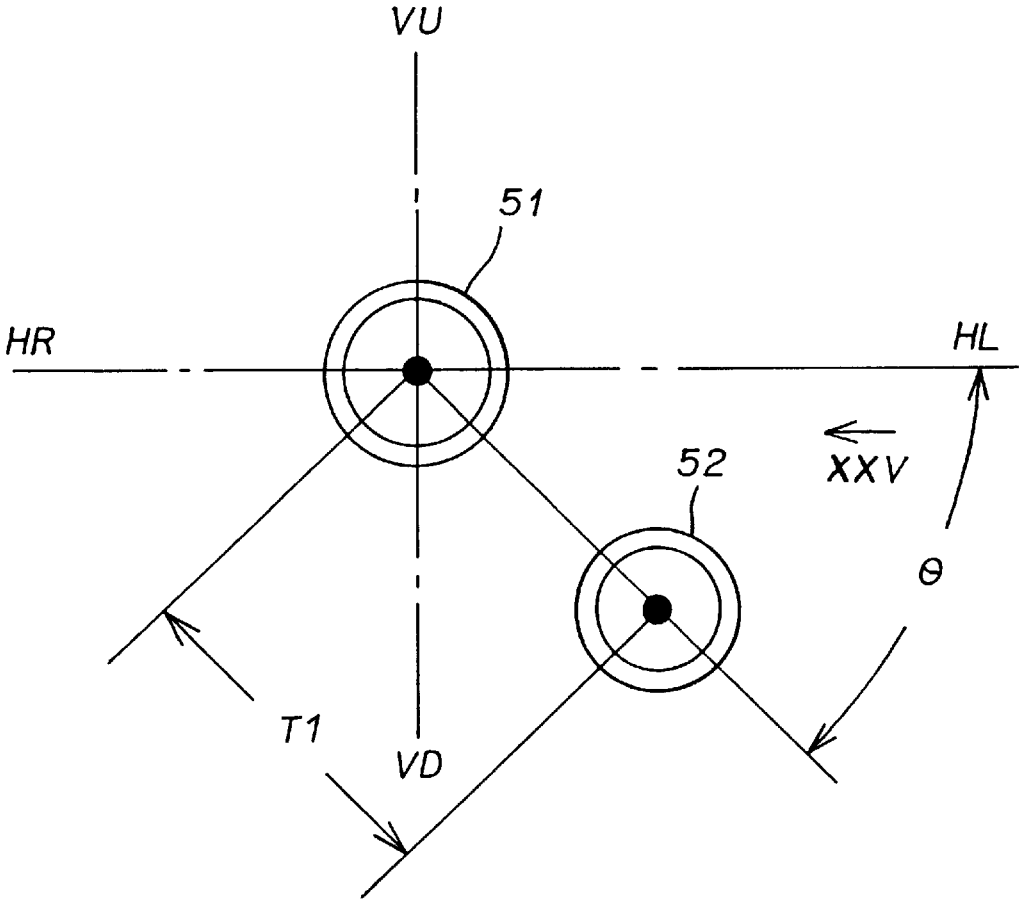
FIG. 24 is a front view for explaining the relative positional relationship between the low-beam filament and the high-beam filament.
Figure 25:
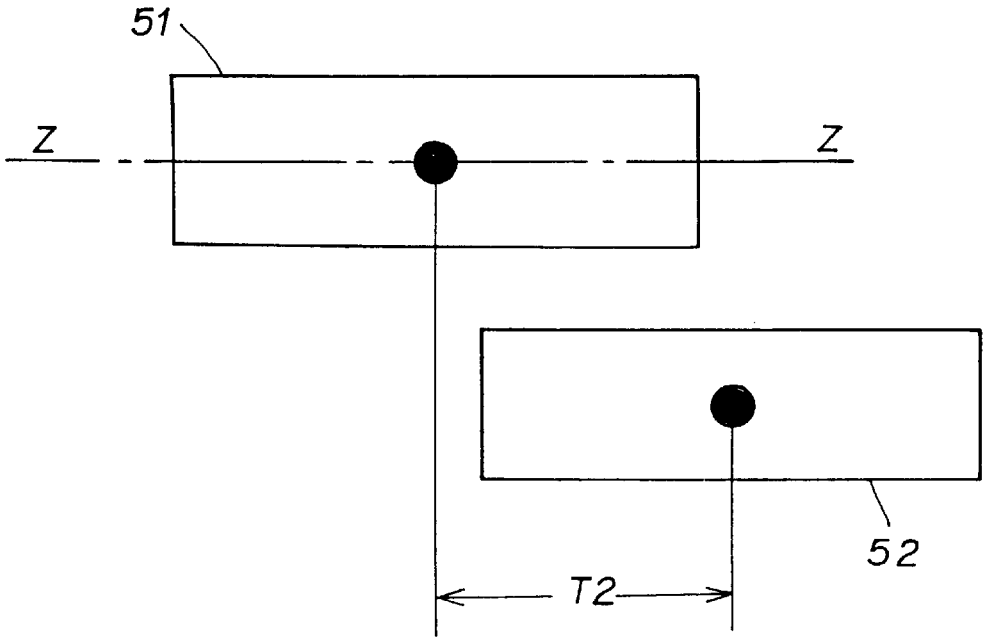
FIG. 25 is a view taken along the arrow XXV in FIG. 24.

FIGS. 22 and 23 show a variation example on the light source bulb 500 of the first invention in this embodiment.

In this variation example, the third support wire SW3 has a curved-surface bent portion SW300 bent to an obtuse angle.

The bulb in this variation example can achieve the same functions and effects as those in the embodiment described above. For example, similarly to the curved-surface bent portion SW30 of the third support wire SW3 in the embodiment described above, the curved-surface bent portion SW300 of the third support wire SW3 lying in the semi-shading coverage C' has a very small area, which combines with the light diffusing function of the bending curved-surface to get rid of virtual image glare.

In addition, a part of the third support wire SW3 forward of the semi-shading coverage C' is put in the shading coverage C, so that the effect of the shading function of the high-beam filament 52 avoids virtual image glare as described above.

Especially, in this variation example the curved surface bent portion SW300 of the third support wire SW3 is bent in an obtuse angle. This facilitates bending by a bending machine. For instance, small bending widths and acute-angle bending constitute harsh conditions for the bending by a bending machine. In this variation example, however, the conditions for the bending by a bending machine are considerably eased.

Now, referring to FIGS. 24 through 27B, description will be made on the concrete example of the light distribution patterns in an automotive headlamp using the light source bulb 500 of the first invention described above.

The reflecting surface 40 of the reflector 4 is 90 mm×180 mm×85 mm in size, and is 25 mm in pseudo focus value.

The light source bulb 500 has such a condition that: the low-beam filament 51 is 5.5 mm in length; the low-beam filament 51 is ϕ1.5 mm in diameter; the low-beam filament 51 is 860 lm in the quantity of luminous flux; the high-beam filament 52 is 5.0 mm in length; the high-beam filament 52 is ϕ1.3 mm in diameter; the high-beam filament 52 is 1300 lm in the quantity of luminous flux; and the glass envelope 50 is ϕ16 mm in diameter. This condition of the light source bulb 500 is an example which is empirically properly and realistically obtained in consideration of life, quantity of light, producibility, usability, performance sustainability, and the like for an automotive headlamp. The quantities of luminous flux mentioned above are determined at a voltage of 12 V.

As for the relative positional relationships between the low-beam filament 51 and the high-beam filament 52: the angleθ formed between a segment connecting the center of the low-beam filament 51 to the center of the high-beam filament 52 and the horizontal line HL-HR in the front view is 20°; the distance T1 between the center of the low-beam 51 and the center of the high-beam filament 52 in the front view is 2.8 mm; and the distance T2 between the center of the low-beam filament 51 and the center of the high-beam filament 52 in the side view is 2.5 mm. It should be noted that the foregoing conditions are just an example.

Moreover, the bending angle (the angle formed between the line L3 and the line L4) ψ of the bent portion LW40 on the front end of the fourth lead wire LW4 is 45°.

Figure 26A:
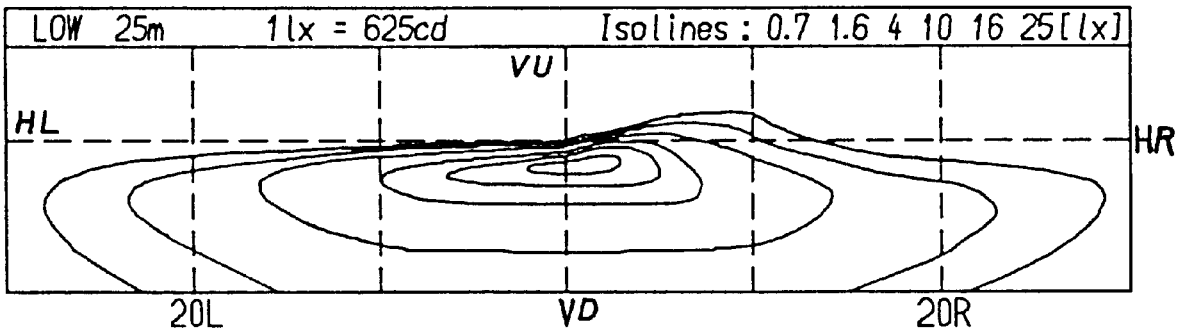
FIG. 26A is an iso-luminance chart showing the light distribution pattern of the low beam for right traffic.
Figure 26B:
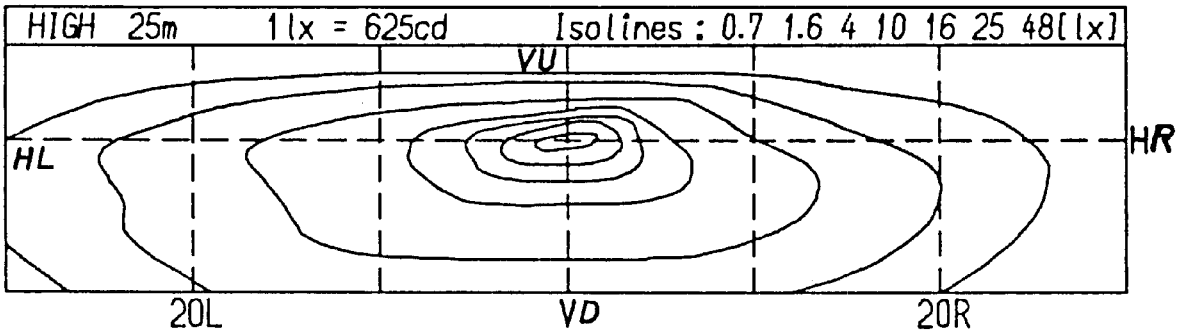
FIG. 26B is also an iso-luminance chart showing the light distribution pattern of the high beam for right traffic.
Figure 27A:
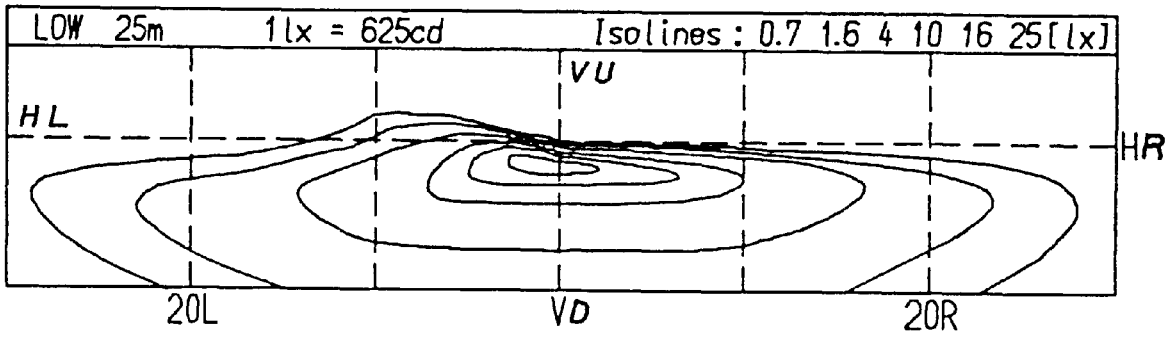
FIG. 27A is an iso-luminance chart showing the light distribution pattern of the low beam for left traffic.
Figure 27B:
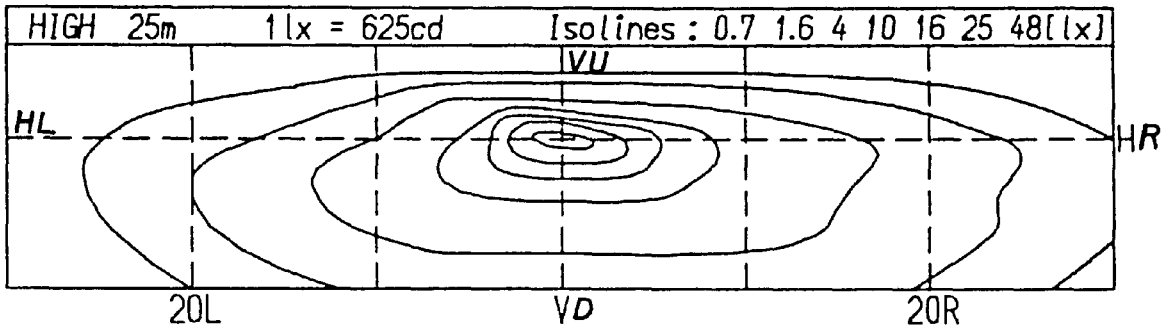
FIG. 27B is also an iso-luminance chart showing the light distribution pattern of the high beam for left traffic.

When the light source bulb 500 and the reflecting surface 40 of the reflector 4 described above are used, no difference is seen in performance between, or no virtual image glare is seen from, the iso-luminance charts of FIGS. 26A and 26B for the right-traffic (FIG. 26A showing the low beam distribution pattern, FIG. 26B showing the high beam distribution pattern) and the iso-luminance charts of FIGS. 27A and 27B for the left-traffic (FIG. 27A showing the low beam distribution pattern, FIG. 27B showing the high beam distribution pattern).

In the embodiment described above the curved-surface bent portions SW30 and SW300 of the third support wire SW3 are arranged within the semi-shading coverage C' (and the shading coverage C). The light source bulb 500 of the first invention, however, can be realized in both cases where the curved-surface bent portions SW30 and SW300 of the third support-wire SW3 are arranged within the semi-shading coverage C' (and the shading coverage C) as in the embodiment described above and where the curved-surface bent portions SW30 and SW300 of the third support wire SW3 are arranged behind the semi-shading coverage C' (on the side of the bridge 57, on the side of the sealed portion (not-shown) of the glass envelope 50), as long as it is free from a problem in the working clearance for wire jointing machines or a problem of virtual image glare, respectively.

Figure 28:
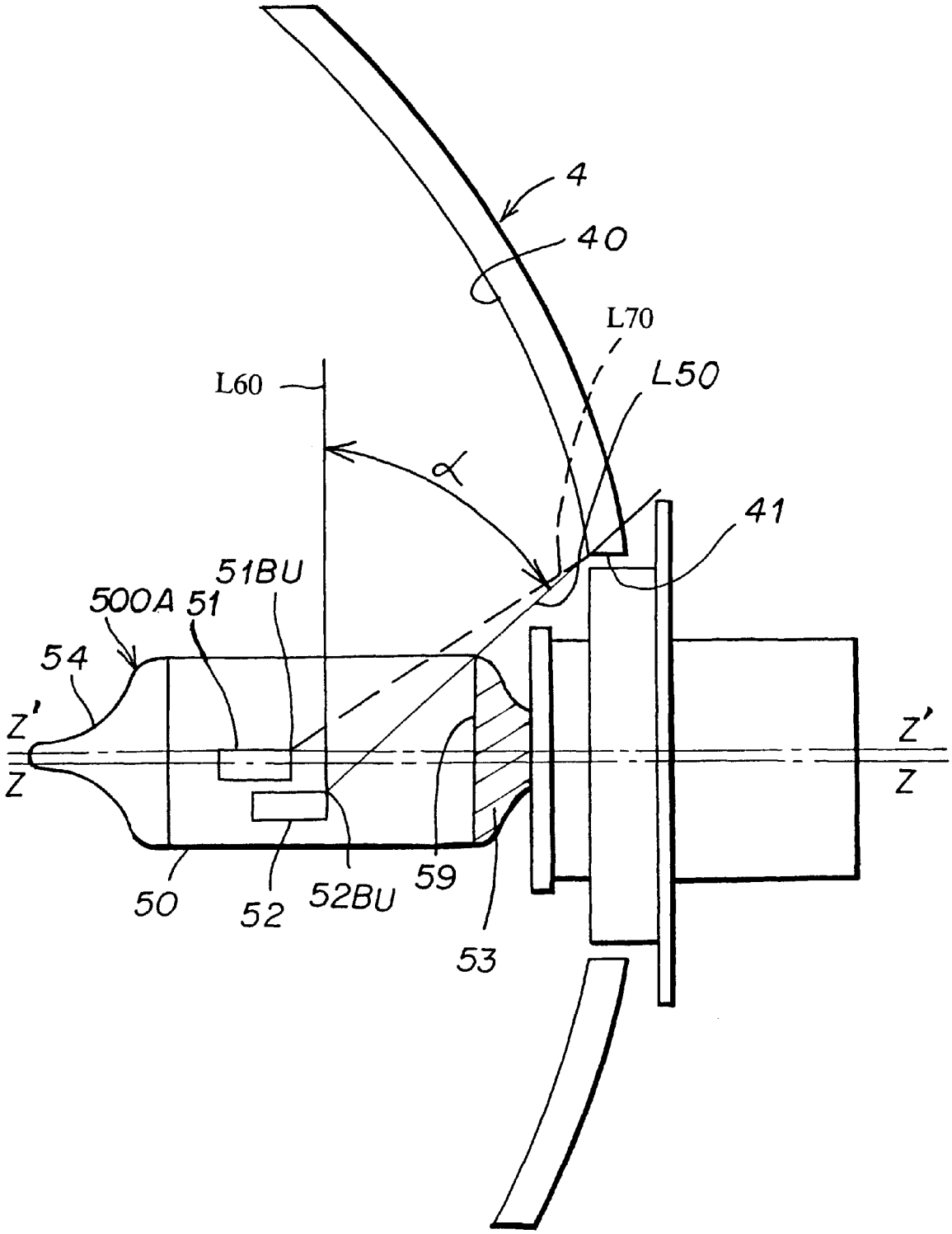
FIG. 28 is a partial longitudinal sectional view showing an embodiment of the light source bulb of the second invention.

FIG. 28 shows an embodiment of the light source bulb of the second invention.

In this light source bulb 500A, the boundary 59 (the starting points of the curve-deformed portions 53L and 53R of the rear-end sealed part 53) between the middle envelope part and the rear-end sealed part 53 (the part shown the oblique lines in the figure) of the glass envelope 50 is positioned behind a line L50 connecting the corner 52BU formed between the rear end and upper end of the high-beam filament 52 in the neutral state to a corner formed between the reflecting surface 40 of the reflector 4 and the inner periphery of the insertion through-hole 41.

The light source bulb 500A of the second invention in this embodiment has such configuration as described above. Accordingly, when this light source bulb 500A is rotated to the left and right about the central axis Z-Z of the low-beam filament 51 for use as a right-traffic light source bulb and a left-traffic light source bulb, respectively, the light L70 (shown by a broken line, in the figure) from the low-beam filament 51 and the light L50 (shown by a full line, in the figure) from the high-beam filament 52 reach the reflecting surface 40 of the reflector 4 without passing through the rear-end sealed part 53 of the glass envelope 50 even if the right and left curve-deformed portions 53R, 53L are situated up and down. This eliminates the optical-path changes in the curve-deformed portions 53L and 53R of the rear-end sealed part 53, the production of glare, and the light-distributional problem. Besides, the lights from the low-beam filament 51 and the high-beam filament 52 reach the entire reflecting surface 40 of the reflector 4, thereby eliminating the losses in quantity of the low beam and the high beam.

Here, it should be noted that the light source bulb 500A shown in FIG. 28 is in its most disadvantageous, neutral state. When this light source bulb 500A in the neutral state is rotated to the right or left about the central axis Z-Z of the low-beam filament 51 for use as a left-traffic light source bulb or a right-traffic light source bulb, respectively, the high-beam filament 52 shown in FIG. 28 approaches the optical axis Z-Z and thereby eliminates the light-distributional problem resulting from glare, and the losses in the quantity of distributed lights.

Thus, the light source bulb 500A of the second invention in this embodiment can be used both as a left-traffic light source bulb and a right-traffic light source bulb in one, without the light-distributional problem due to glare of low beam and the losses in the quantity of distributed low beam and high beam.

Next, description will be given of the concrete dimensions of major components.

The pseudo focus F value of the reflector 4 is equivalent to a 20-to-30-mm focus value of the paraboloids of revolution, in consideration of the size for an automotive headlamp and the magnitude (solid angle) of the emission pattern required for the light distribution.

The distance between the center of the low-beam filament 51 and the center of the high-beam filament 52 in the front view is 2.0–3.5 mm.

The lengths c of the low-beam filament 51 and the high-beam filament 52 are 4.0–6.0 mm in consideration of life, luminous flux, efficiency, dimension of the light source image required for the light distribution, and the like.

The inner diameter of the insertion through-hole 41 is equal to or greater than $\phi$30 mm on account of the assembly size of the above-described light source bulb 500.

Among the concrete dimensions of the major components mentioned above, those constituting the most disadvantageous condition are combined to obtain $\alpha$ (an angle formed between the line L50 described above and a line L6 which is perpendicular to the optical axis Z-Z and drawn through the rear end of the high-beam filament 52, the angle showing the required range of the middle envelope part to the starting point of the rear-end sealed part 53 of the glass envelope 50), resulting in that $\alpha$=55° (where a (focal length of the reflector): 30 mm, b (interval of the filament): 3.5 mm, c (length of the filament): 6.0 mm, and d (hole diameter of the bulb of the reflector): $\phi$30 mm). Here, any combination of the conditions conceivable for a realistic solution produces no light-distributional problem resulting from glare of low beam, nor loss in the quantity of distributed low beam and light beam.

Figure 29:
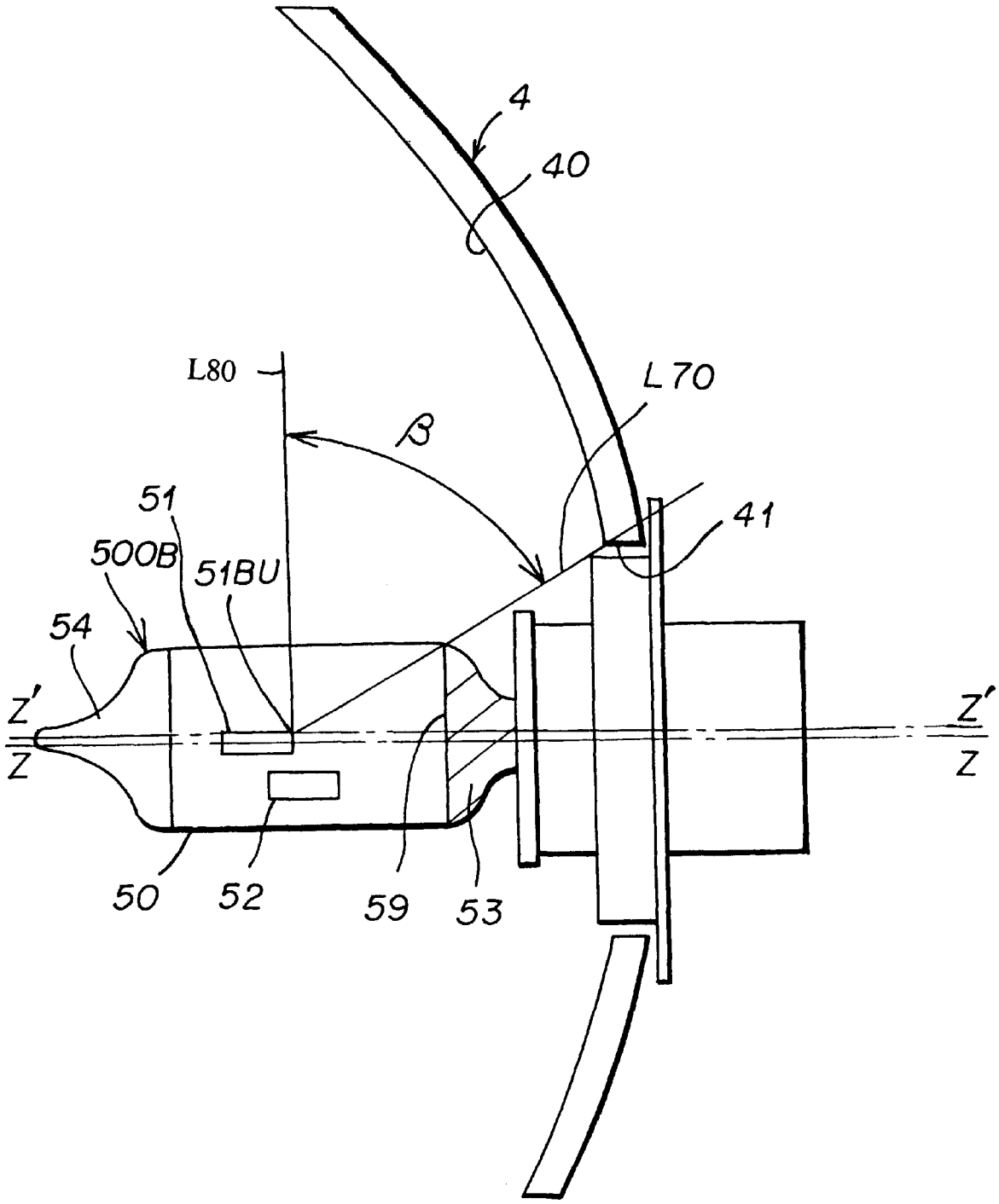
FIG. 29 is a partial longitudinal sectional view showing an embodiment of the light source bulb of the third invention.

FIG. 29 is a partial longitudinal sectional view showing an embodiment of the light source bulb of the third invention.

In this light source bulb 500B, the boundary 59 between the middle envelope part and the rear-end sealed part 53 (the part shown by the oblique lines in the figure) of the glass envelope 50 is positioned behind a line L70 connecting the corner 51BU formed between the rear end and upper end of the high-beam filament 51 in the neutral state to a corner formed between the reflecting surface 40 of the reflector 4 and the inner periphery of the insertion through-hole 41.

The light source bulb 500B in this embodiment has such configuration as described above; therefore, when this light source bulb 500B is rotated to the left and right about the central axis Z-Z of the low-beam filament 51 for use as a right-traffic light source bulb and a left-traffic light source bulb, respectively, the light (shown by a full line, in the figure) L70 from the low-beam filament 51 reaches the reflecting surface 40 of the reflector 4 without passing through the rear-end sealed part 53 of the glass envelope 50 even if the right and left curve-deformed portions 53R, 53L are situated up and down. This eliminates the optical-path changes in the curve-deformed portions 53L and 53R of the rear-end sealed part 53, the production of glare, and the light-distributional problem. Besides, the lights from the low-beam filament 51 reach the entire reflecting surface 40 of the reflector 4, thereby eliminating the loss in the quantity of low beam.

It should be noted here that the light source bulb 500B shown in FIG. 29 is in its most disadvantageous, neutral state. When this light source bulb 500B in the neutral state is rotated to the right and left about the central axis Z-Z of the low-beam filament 51 for use as a left-traffic light source bulb or a right-traffic light source bulb, respectively, the high-beam filament 51 shown in FIG. 29 remains there, eliminating the light-distributional problem resulting from glare as well as the loss in the quantity of distributed lights.

Thus, the light source bulb 500B in this embodiment can be used both as a left-traffic light source bulb and a right-traffic light source bulb in one, without the light-distributional problem due to low beam glare or the loss in the quantity of distributed low beam.

Among the concrete dimensions of the major components mentioned above, those constituting the most disadvantageous condition are combined to obtain $\beta$ (an angle formed between the line L70 described above and a line L80 which is perpendicular to the central axis Z-Z and drawn through the rear end 51B of the low-beam filament 51, the angle showing the required range of the middle envelope part to the starting point of the rear-end sealed part 53 of the glass envelope 50), resulting in that $\beta$=62° (where a: 30 mm, c: 6.0 mm, and d: $\phi$30 mm). Here, any combination of the conditions conceivable for a realistic solution produce no light-distributional problem resulting from low beam glare, nor loss in the quantity of distributed low beam.

Figure 30A:
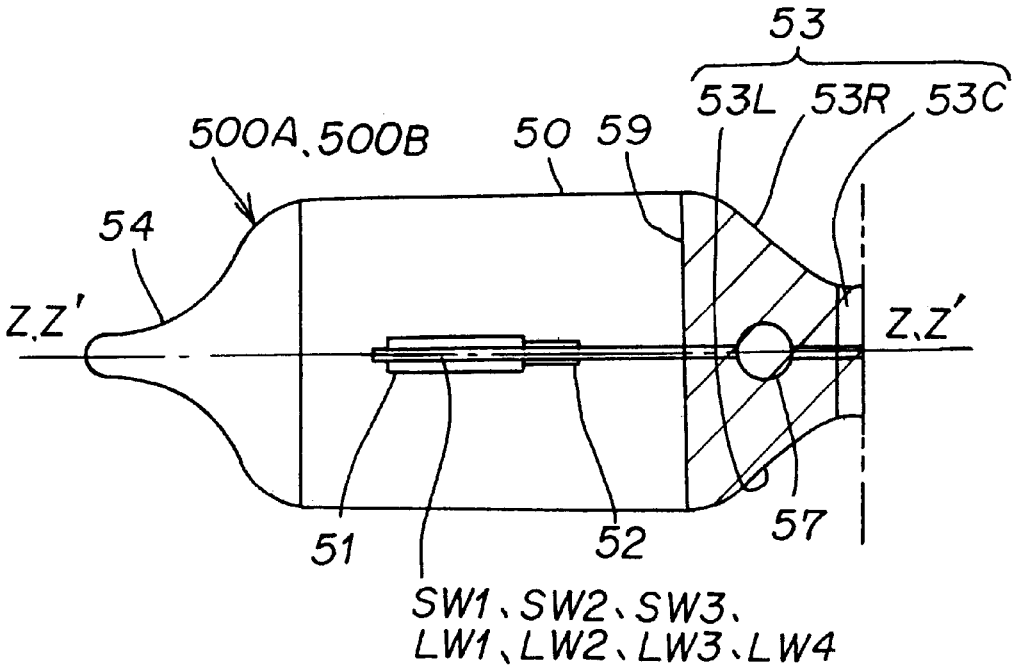
FIG. 30A is a partial plan view showing a variation example of the second invention and the third invention.
Figure 30B:
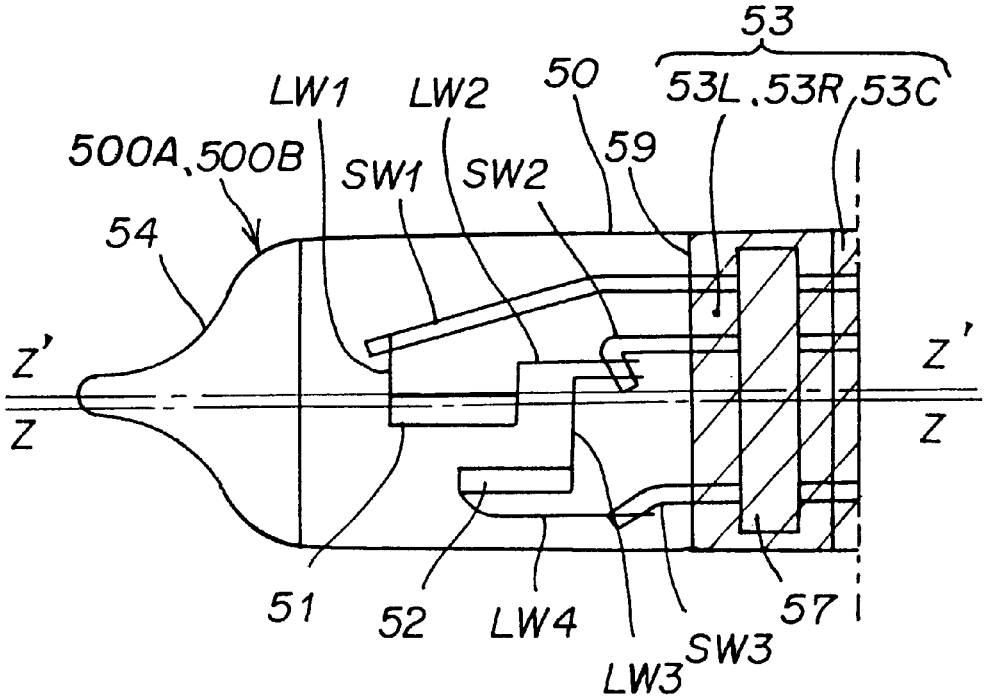
FIG. 30B is a partial side view showing the same.

FIGS. 30A and 30B are a partial plan view and a partial side view of a variation example on the light source bulb 500A of the second invention and the light source bulb 500B of the third invention.

In the light source bulbs 500A and 500B of this variation example, the corner between the front end and upper end of the low-beam filament 51 is supported by a first lead wire LW1 and a first support wire SW1. The corner between the rear end and upper end of the low-beam filament 51 and the corner between the rear end and upper end of the high-beam filament 52 are supported by a second lead wire LW2, a third lead wire LW3, and a second support wire SW2. The corner between the front end and lower end of the high-beam filament 52 is supported by the fourth lead wire LW4 and a third support wire SW3. Moreover, the support wires SW1, SW2, and SW3 mentioned above are fixed to and supported by a bridge 57 made of glass, and this bridge 57 is contained in a rear-end sealed part 53 (the part shown by the oblique lines in the figures).

In the light source bulbs 500A and 500B of this variation example, the lead wires LW1, LW2, LW3, and LW4, and support wires SW1, SW2, and SW3 each is positioned, as in the front view of the light source bulbs 500A and 500B in the neutral state, between a line drawn from the left end of the low-beam filament 51 through the left end of the high-beam filament 52 and a product drawn from the right end of the low-beam filament 51 through the right end of the high-beam filament 52. In other words, the wires are arranged on a line connecting the low-beam filament 51 to the high-beam filament 52. This facilitates wiring of the above-mentioned wires.

Besides, the light source bulbs 500A and 500B in this variation example have a rear-end sealed part 53 whose planar portion (pinched portion) 53C is placed on the line connecting the low-beam filament 51 to the high-beam filament 52. Therefore, this rear-end sealed part 53 can be formed by squeeze from both the right and left sides of the line connecting the low-beam filament 51 to the high-beam filament 52, which facilitates manufacture of the light source bulbs 500A and 500B.

Moreover, the light source bulbs 500 A and 500B in this variation example employ a light source bulb having the bridge 57 contained in the rear-end sealed part 53. This eliminates the light quantity loss resulting from the bridge 57, and provides a larger space within the glass envelope 50 to avoid interference in the cycle efficiency of filler gases such halogen gas.

While in the embodiments of the first, second, and third inventions described above the first, second, and third support wires SW1, SW2, and SW3 are fixed to a bridge 57, this bridge 57 may be omitted in consideration of the manufacturing facility of the light source bulbs.

In addition, since the prescribed low-beam distribution pattern LP and high-beam distribution pattern HP are controlled and formed by means of the entire-surface reflection light distribution of the reflecting surface 40, the lens 2 may be a plain glass or a lens comprising a diffusion system optical element group (so-called diffusion system prism element group) and the like.

Besides, while description has been made on the examples where the lamp housing 1 and the reflector 4 having the reflecting surface 40 are separate from each other, the light source bulbs 500, 500A, and 500B of the present invention are applicable to those having a lamp housing integral with the reflector.

Particularly, the light source bulbs 500, 500A, and 500B of the present invention may sometimes be used exclusively for a left-traffic or a right-traffic light source bulb. Even in this case, they fall within the scope of the light source bulbs of the present invention.

While there has been described what are at present considered to be preferred embodiments of the invention, it will be understood that various modifications may be made thereto, and it is intended that the appended claims cover all such modifications as fall within the true spirit and scope of the invention.

What is claimed is:

1. A light source bulb in an automotive headlamp, said automotive headlamp having a lamp chamber defined by a lamp housing and a lens, said lamp chamber having a reflector and said light source bulb arranged therein, said reflector having a reflecting surface constituted by a complex reflecting surface, said light source bulb having a high-beam filament arranged obliquely below and behind with respect to a low-beam filament, a first lead wire extended from a front end of said low-beam filament being supported by a first support wire, a second lead wire extended from a rear end of said low-beam filament being supported by a second support wire, a third lead wire extended from a rear end of said high-beam filament being supported by said second support wire, a fourth lead wire extended from a front end of said high-beam filament being supported by a third support wire, a prescribed low beam distribution pattern being formed by entire-surface reflection light distribution control of said reflecting surface when said low-beam filament is lit, a prescribed high beam distribution pattern being formed by the entire-surface reflection control of said reflecting surface when said high-beam filament is lit, wherein said light source bulb is used for right traffic and for left traffic, at least one of said lead wires and said support wires situated below said low-beam filament lies in a shading coverage of said high-beam filament when said low-beam filament is lit; and wherein said second support wire is, in a side view of said light source bulb, bent to rearward of the rear end of said high-beam filament and positioned above the lower end of said low-beam filament such that no portion of the second support wire is located below the lower end of the low-beam filament.

2. The light source bulb in an automotive headlamp according to claim 1, wherein said fourth lead wire is, in the front view of said light source bulb, arranged between a line drawn from a left end of said low-beam filament through a left end of said high-beam filament and a line drawn from a right end of said low-beam filament through a right end of said high-beam filament, and is, in a side view of said light source bulb, extended from the front end to rearward of said high-beam filament through below the same and positioned behind a line drawn from a corner formed between the front end and lower end of said low-beam filament through a corner formed between the front end and lower end of said high-beam filament.

3. The light source bulb in an automotive headlamp according to claim 1, wherein said third support wire is, in the front view of said light source bulb, arranged between a line drawn from a left end of said low-beam filament through a left end of said high-beam filament and a line drawn from a right end of said low-beam filament through a right end of said high-beam filament, and is, in a side view of said light source bulb, bent to a curved surface at its portion forward of a line drawn from a corner formed between the rear end and lower end of said low-beam filament through a corner formed between the rear and upper end of said high-beam filament, said curved surface diffusing light from said low-beam filament.

4. A light source bulb in an automotive headlamp, said automotive headlamp having a lamp chamber defined by a lamp housing and a lens, said lamp chamber having a reflector and said light source bulb arranged therein, said reflector including a reflecting surface constituted by a complex reflecting surface and having a through hole for insertion of said light source bulb, said light source bulb having a high-beam filament arranged obliquely below with respect to a low-beam filament, a prescribed low beam distribution pattern being formed by entire-surface reflection light distribution control of said reflecting surface when said low-beam filament is lit, a prescribed high beam distribution pattern being formed by the entire-surface reflection control of said reflecting surface when said high-beam filament is lit, wherein said light source bulb has said low-beam filament and said high-beam filament enclosed in a glass envelope, a first lead wire extended from a front end of said low-beam filament being supported by a first support wire, a second lead wire extended from a rear end of said low-beam filament being supported by a second support wire, a rear end part of said glass envelope being sealed at portions on both a right and left sides with respect to a line connecting said low-beam filament to said high-beam filament, a boundary between a middle envelope part and the rear-end sealed part of said glass envelope being positioned behind a first line connecting a corner formed between the rear end and upper end of said high-beam filament to a corner of the inner periphery of said through hole for insertion in said reflector and a second line connecting a corner formed between the rear end and upper end of said low-beam filament, wherein the rear end part of said glass envelope does not pass light, and wherein, the first and second lines pass through the middle envelope part, wherein said second support wire is, in a side view of said light source bulb, bent to rearward of the rear end of said high-beam filament and positioned above the lower end of said low-beam filament such that no portion of the second support wire is located below the lower end of the low-beam filament.

5. The light source bulb in an automotive headlamp according to claim 4, wherein: said high beam filament is supported by a third lead wire and said second support wire; and said third lead wire and said second support wire are arranged on a plane connecting said low-beam filament to said high-beam filament.

6. The light source bulb in an automotive headlamp according to claim 4, wherein: said high beam filament is supported by a third lead wire and said second support wire; said second support wire is supported by a bridge; and said bridge is arranged in the rear-end sealed part of said glass envelope.

7. The light source bulb in an automotive headlamp according to claim 1, wherein the third support wire is, in a side view of said light source bulb, bent to form a bend portion having a curved surface, said bend portion located forward of a first line defined by a lower rear corner of the low-beam filament and extending through an upper rear corner of the high-beam filament.

8. The light source bulb in an automotive headlamp according to claim 7, wherein the bend portion is located behind a second line defined by an upper rear corner of the low-beam filament and extending through the upper rear corner of the high-beam filament.

9. The light source bulb in an automotive headlamp according to claim 7, wherein the third support wire is bent to rearward such that the bend portion is bent to form an acute angle.

10. The light source bulb in an automotive headlamp according to claim 4, further comprising a third lead wire extended from a rear end of said high-beam filament being supported by said second support wire, and a fourth lead wire extended from a front end of said high-beam filament being supported by a third support wire.

11. The light source bulb in an automotive headlamp according to claim 10, wherein the third support wire is, in a side view of said light source bulb, bent to form a bend portion having a curved surface, said bend portion located forward of a first line defined by a lower rear corner of the low-beam filament and extending through an upper rear corner of the high-beam filament.

12. The light source bulb in an automotive headlamp according to claim 11, wherein the bend portion is located behind a second line defined by an upper rear corner of the low-beam filament and extending through the upper rear corner of the high-beam filament.

13. The light source bulb in an automotive headlamp according to claim 11, wherein the third support wire is bent to rearward such that the bend portion is bent to form an acute angle.

* * * * *